US010863794B2

(12) United States Patent
Bruce

(10) Patent No.: US 10,863,794 B2
(45) Date of Patent: Dec. 15, 2020

(54) ARTICLE OF FOOTWEAR HAVING MULTIPLE BRAIDED STRUCTURES

(71) Applicant: NIKE, Inc., Beaverton, OR (US)

(72) Inventor: Robert M. Bruce, Portland, OR (US)

(73) Assignee: NIKE, INC., Beaverton, OR (US)

( * ) Notice: Subject to any disclaimer, the term of this patent is extended or adjusted under 35 U.S.C. 154(b) by 556 days.

(21) Appl. No.: 14/566,215

(22) Filed: Dec. 10, 2014

(65) Prior Publication Data

US 2015/0201707 A1 Jul. 23, 2015

Related U.S. Application Data

(63) Continuation-in-part of application No. 14/163,438, filed on Jan. 24, 2014.

(60) Provisional application No. 61/839,097, filed on Jun. 25, 2013.

(51) Int. Cl.

| | |
|---|---|
| ***A43B 23/02*** | (2006.01) |
| ***A43B 1/04*** | (2006.01) |
| ***A43B 23/04*** | (2006.01) |

(52) U.S. Cl.

CPC ..... *A43B 23/0235* (2013.01); *A43B 1/04* (2013.01); *A43B 23/0245* (2013.01); *A43B 23/0295* (2013.01); *A43B 23/04* (2013.01); *A43B 23/042* (2013.01); *D10B 2501/043* (2013.01)

(58) Field of Classification Search

CPC ..... A43B 1/04; A43B 23/0235; A43B 23/024; A43B 23/0245; A43B 23/0295; A43B 23/04; A43B 23/042; A43B 23/0215; A43B 23/026; A43B 23/0225; A43B 23/07; A43B 23/0265; A43B 23/0205; A43B 23/0255; D04C 1/06; D10B 2501/043

USPC ..... 36/45, 55, 3 A, 9 R, 46.5, 49, 51, 87

See application file for complete search history.

(56) References Cited

U.S. PATENT DOCUMENTS

| | | | | |
|---|---|---|---|---|
| 165,941 A | | 7/1875 | Malhebe | |
| 329,739 A | | 11/1885 | Heostkels | |
| 376,372 A | | 1/1888 | Dodge et al. | |
| 509,241 A | * | 11/1893 | Packard | A43B 23/02 36/45 |
| 578,294 A | | 3/1897 | Leayitt | |

(Continued)

FOREIGN PATENT DOCUMENTS

| | | | |
|---|---|---|---|
| BE | 426 458 | A | 3/1938 |
| CN | 86209002 | U | 10/1987 |

(Continued)

OTHER PUBLICATIONS

International Search Report and Written Opinion dated Sep. 19, 2014 in PCT/US2014/041659.

(Continued)

*Primary Examiner* — Jameson D Collier

(74) *Attorney, Agent, or Firm* — Shook, Hardy & Bacon L.L.P.

(57) ABSTRACT

An article of footwear includes an upper with a first braided structure, a second braided structure, and an overlay system. The overlay system is bonded to the first braided structure and the overlay system is bonded to the second braided structure. The overlay system may be more resistant to stretching than the first braided structure and the overlay system may be more resistant to stretching than the second braided structure.

16 Claims, 27 Drawing Sheets

(56) References Cited

U.S. PATENT DOCUMENTS 586,137 A * 7/1897 Medger ..... A43B 23/024 36/3 A
621,922 A * 3/1899 Kelsall ..... A43B 23/024 36/11.5
972,718 A 10/1910 Rahm
1,182,325 A * 5/1916 Sedmak ..... A43B 7/06 36/3 A
1,318,888 A 10/1919 Le Carpentier
1,527,344 A 2/1925 Bente et al.
1,538,160 A 5/1925 Bosebeck
1,540,903 A * 6/1925 Santoyo ..... A43B 7/06 12/142 V
1,554,325 A 9/1925 Bente
1,583,273 A 5/1926 Bosebeck
1,597,934 A 8/1926 Stimpson
1,600,621 A * 9/1926 Buek, Jr. ..... A43B 1/02 12/142 V
1,622,021 A 3/1927 Birkin et al.
1,637,716 A 8/1927 Turck
1,663,319 A * 3/1928 Snell ..... A43B 1/02 12/142 V
1,687,643 A 10/1928 Berliner
1,713,307 A * 5/1929 Stritter ..... A43B 23/25 36/3 A
1,717,183 A * 6/1929 Brenner ..... A43B 23/0295 12/146 R
1,730,768 A 10/1929 Heyman
1,803,554 A * 5/1931 Knilans ..... A43B 5/00 36/114
1,828,320 A * 10/1931 Daniels ..... A43B 23/0235 36/3 A
1,832,691 A * 11/1931 David ..... A43B 3/10 12/146 C
1,864,254 A * 6/1932 Meyer ..... A43B 3/126 36/11.5
1,877,080 A * 9/1932 Teshima ..... A43B 5/18 36/116
1,887,643 A 11/1932 Otto
1,949,318 A * 2/1934 Markowsky ..... A43C 11/002 36/3 A
D91,999 S 4/1934 Heilbrunn
2,001,293 A 5/1935 Wallace
2,022,350 A 11/1935 Otto
2,091,215 A 8/1937 Price
2,144,689 A * 1/1939 Roberts ..... A43C 11/002 112/405
2,147,197 A * 2/1939 Glidden ..... A43B 1/02 36/3 A
2,161,472 A * 6/1939 Hurwit ..... A43B 1/02 12/142 V
2,165,092 A 7/1939 Daniels
2,188,640 A 1/1940 Bloch et al.
RE21,392 E * 3/1940 Hurwit ..... A43B 1/04 36/3 A
2,271,888 A 2/1942 Manley
2,311,959 A * 2/1943 Nurk ..... A43B 1/04 36/11
D137,767 S * 4/1944 Goldstein ..... 36/9 R
2,382,559 A * 8/1945 Goldstein ..... A43B 1/02 12/142 G
2,412,808 A 12/1946 Goldstein
2,521,072 A 9/1950 Lovell
D164,847 S * 10/1951 Dronoff ..... A43B 23/0295 D2/971
2,586,045 A * 2/1952 Hoza ..... A43B 1/04 36/14
2,617,129 A 11/1952 Petze
2,641,004 A 6/1953 Whiting et al.
2,675,631 A * 4/1954 Doughty ..... A43B 1/04 36/12
2,679,117 A * 5/1954 Reed ..... A43B 3/14 12/142 G
2,701,887 A 2/1955 Nolan
2,936,670 A 5/1960 Erwin
3,052,904 A 9/1962 Reid et al.
3,081,368 A 3/1963 Wunsche
3,257,677 A 6/1966 Batchelder et al.
3,282,757 A 11/1966 Brussee
3,397,847 A 8/1968 Thaden
3,474,478 A 10/1969 Batchelder et al.
3,504,450 A 4/1970 Steadman et al.
3,525,110 A 8/1970 Rubico
3,586,058 A 6/1971 Ahrens et al.
3,619,838 A 11/1971 Winkler
3,714,862 A 2/1973 Berger
3,745,600 A 7/1973 Rubico et al.
3,805,667 A 4/1974 Orser
3,821,827 A 7/1974 Nadler
3,866,512 A 2/1975 Berger
4,134,955 A 1/1979 Hanrahan, Jr. et al.
4,149,249 A 4/1979 Pavkovich
4,194,249 A 3/1980 Thorneburg
4,222,183 A * 9/1980 Haddox ..... A43B 5/00 36/114
4,232,458 A 11/1980 Bartels
4,275,638 A 6/1981 DeYoung
4,341,097 A 7/1982 Cassidy, Sr. et al.
4,351,889 A 9/1982 Sundberg
4,394,803 A * 7/1983 Goldstein ..... A43C 7/02 36/50.1
4,430,811 A 2/1984 Okada
4,447,967 A 5/1984 Zaino
4,519,290 A 5/1985 Inman et al.
4,587,749 A 5/1986 Berlese
4,591,155 A 5/1986 Adachi
4,629,650 A 12/1986 Kataoka
4,640,027 A 2/1987 Berlese
4,662,088 A * 5/1987 Autry ..... A43B 23/0235 36/105
4,719,837 A 1/1988 McConnell et al.
4,785,558 A 11/1988 Shiomura
4,800,796 A 1/1989 Vendramini
4,847,063 A 6/1989 Smith
4,848,745 A 7/1989 Bohannan et al.
4,857,124 A 8/1989 Shobert et al.
4,879,778 A 11/1989 Becka et al.
4,882,858 A 11/1989 Signori
4,885,973 A 12/1989 Spain
4,916,997 A 4/1990 Spain
4,919,388 A 4/1990 Koike et al.
4,939,805 A 7/1990 Walega
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump et al.
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A 8/1994 Thorneburg et al.
5,344,315 A 9/1994 Hanson
5,345,638 A * 9/1994 Nishida ..... A41H 3/08 12/146 C
5,348,056 A 9/1994 Tsuzuki
5,361,674 A 11/1994 Akiyama et al.
5,381,610 A * 1/1995 Hanson ..... A43B 3/24 12/142 T
5,385,077 A 1/1995 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,647,150 A 7/1997 Romanato et al.
5,732,413 A 3/1998 Williams et al.
5,885,622 A 3/1999 Daley
5,896,758 A 4/1999 Rock et al.
5,901,632 A 5/1999 Ryan
6,024,005 A 2/2000 Uozumi

(56) References Cited

U.S. PATENT DOCUMENTS 6,029,376 A * 2/2000 Cass ..... A43C 1/04 36/50.1
6,205,683 B1 3/2001 Clark et al.
6,298,582 B1 * 10/2001 Friton ..... A43B 5/06 36/102
6,308,536 B2 10/2001 Roell
6,345,598 B1 2/2002 Bogdanovich et al.
6,401,364 B1 * 6/2002 Burt ..... A43B 1/00 36/3 A
6,451,046 B1 9/2002 Leo et al.
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,910,288 B2 6/2005 Dua
6,931,762 B1 * 8/2005 Dua ..... A43B 1/04 12/142 G
6,945,153 B2 9/2005 Knudsen et al.
6,971,252 B2 12/2005 Therin
7,004,967 B2 2/2006 Chouinard et al.
7,047,668 B2 5/2006 Burris et al.
7,093,527 B2 8/2006 Rapaport et al.
7,168,951 B2 1/2007 Fischer et al.
7,204,903 B2 4/2007 Yasui
7,228,777 B2 6/2007 Morissette et al.
7,252,028 B2 8/2007 Bechtold et al.
7,262,353 B2 8/2007 Bartholomew et al.
7,275,471 B2 10/2007 Nishri et al.
7,293,371 B2 * 11/2007 Aveni ..... A43B 7/08 36/45
7,300,014 B2 11/2007 Allen
7,347,011 B2 3/2008 Dua et al.
D578,294 S * 10/2008 Mervar ..... D2/969
7,430,818 B2 10/2008 Valat et al.
7,444,916 B2 11/2008 Hirukawa
7,549,185 B2 6/2009 Yang
7,566,376 B2 7/2009 Matsuoka
7,703,218 B2 4/2010 Burgess
7,703,220 B2 4/2010 Aveni
7,793,434 B2 * 9/2010 Sokolowski ..... A43B 23/0235 12/146 C
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.
8,051,585 B2 11/2011 Hope et al.
8,056,173 B2 * 11/2011 RonBo ..... A43B 9/02 12/142 R
8,061,253 B2 11/2011 Wybrow
8,210,086 B2 7/2012 Head et al.
8,261,648 B1 9/2012 Marchand et al.
8,266,827 B2 9/2012 Dojan et al.
8,312,645 B2 11/2012 Dojan et al.
8,312,646 B2 11/2012 Meschter et al.
8,388,791 B2 3/2013 Dojan et al.
8,394,222 B2 3/2013 Rettig
8,438,757 B2 5/2013 Roser
8,511,214 B2 8/2013 Gries
8,544,191 B2 10/2013 Marvin et al.
8,544,197 B2 10/2013 Spanks et al.
8,544,199 B1 10/2013 Pentland
8,578,534 B2 11/2013 Langvin et al.
8,578,632 B2 * 11/2013 Bell ..... A43B 1/0072 36/45
8,651,007 B2 2/2014 Adams
8,690,962 B2 4/2014 Dignam et al.
8,757,038 B2 6/2014 Siegismund
8,770,081 B2 7/2014 David et al.
8,789,295 B2 * 7/2014 Burch ..... A43B 23/0245 12/146 C
8,789,452 B1 7/2014 Janardhan et al.
8,794,118 B2 8/2014 Dow et al.
8,819,963 B2 * 9/2014 Dojan ..... A43B 23/0265 36/45
8,959,959 B1 2/2015 Podhajny
8,984,776 B2 3/2015 Ludemann et al.
8,997,529 B1 * 4/2015 Podhajny ..... D04B 1/16 36/47
D737,561 S * 9/2015 Aveni ..... D2/971
9,179,739 B2 11/2015 Bell et al.
D769,590 S * 10/2016 Aveni ..... D2/935
9,681,708 B2 * 6/2017 Greene ..... A43D 8/00
9,756,901 B2 * 9/2017 Musho ..... A43B 7/06
D798,565 S * 10/2017 Aveni ..... D2/971
10,159,297 B2 12/2018 Jamison
10,238,176 B2 3/2019 Bruce et al.
10,280,538 B2 5/2019 Bruce et al.
2001/0007180 A1 * 7/2001 Bordin ..... A43B 5/0405 36/93
2003/0000111 A1 * 1/2003 Basso ..... A43B 5/04 36/55
2003/0213547 A1 11/2003 Ono et al.
2004/0118018 A1 6/2004 Dua
2004/0244412 A1 12/2004 Trinh et al.
2005/0076536 A1 * 4/2005 Hatfield ..... A43B 3/0057 36/3 B
2005/0081402 A1 * 4/2005 Orei ..... A43B 1/00 36/45
2005/0115284 A1 6/2005 Dua
2005/0178026 A1 8/2005 Friton
2005/0193592 A1 * 9/2005 Dua ..... A43B 1/04 36/45
2005/0208860 A1 9/2005 Baron et al.
2005/0284002 A1 * 12/2005 Aveni ..... A43B 7/08 36/50.1
2006/0048413 A1 * 3/2006 Sokolowski ..... A43B 23/0235 36/45
2006/0059715 A1 3/2006 Aveni
2006/0162190 A1 7/2006 Nishiwaki et al.
2006/0260365 A1 11/2006 Miyamoto
2006/0265908 A1 11/2006 Palmer et al.
2006/0283042 A1 * 12/2006 Greene ..... A43B 9/00 36/3 A
2006/0283048 A1 12/2006 Lebo
2007/0022627 A1 2/2007 Sokolowski et al.
2007/0062067 A1 * 3/2007 Covatch ..... A43B 3/24 36/55
2007/0101615 A1 5/2007 Munns
2007/0101616 A1 5/2007 Munns
2007/0180730 A1 * 8/2007 Greene ..... A43B 9/00 36/3 A
2007/0245595 A1 * 10/2007 Chen ..... A43B 7/08 36/45
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 * 4/2008 Liles ..... A43B 3/0078 36/50.1
2008/0110048 A1 * 5/2008 Dua ..... A43B 1/04 36/45
2008/0250668 A1 * 10/2008 Marvin ..... A43B 9/12 36/54
2009/0126225 A1 5/2009 Jarvis
2009/0126823 A1 5/2009 Yengkhom
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0095557 A1 4/2010 Jarvis
2010/0107442 A1 * 5/2010 Hope ..... A43B 23/024 36/50.1

(56) References Cited

U.S. PATENT DOCUMENTS

2010/0139057 A1 6/2010 Soderberg et al.
2010/0154256 A1* 6/2010 Dua ..... A43B 1/04 36/25 R
2010/0175276 A1 7/2010 Dojan et al.
2010/0199520 A1 8/2010 Dua et al.
2010/0251491 A1* 10/2010 Dojan ..... A43B 23/0225 12/142 R
2010/0251564 A1 10/2010 Meschter
2010/0319215 A1* 12/2010 Roser ..... A43C 1/00 36/27
2011/0041359 A1* 2/2011 Dojan ..... A43B 23/025 36/47
2011/0067271 A1 3/2011 Foxen et al.
2011/0078921 A1* 4/2011 Greene ..... A43B 1/04 36/47
2011/0088285 A1* 4/2011 Dojan ..... A43B 1/04 36/87
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0011744 A1 1/2012 Bell et al.
2012/0023786 A1* 2/2012 Dojan ..... A43B 23/0275 36/25 R
2012/0030965 A1 2/2012 Greene et al.
2012/0055044 A1 3/2012 Dojan et al.
2012/0066931 A1* 3/2012 Dojan ..... A43B 23/0235 36/83
2012/0096742 A1* 4/2012 Shim ..... A43B 23/17 36/45
2012/0100778 A1 4/2012 Cho
2012/0117826 A1 5/2012 Jarvis
2012/0144698 A1* 6/2012 McDowell ..... B29D 35/146 36/45
2012/0159813 A1 6/2012 Dua et al.
2012/0180195 A1 7/2012 Shull et al.
2012/0186102 A1* 7/2012 Lee ..... A43B 1/0027 36/45
2012/0198730 A1 8/2012 Burch et al.
2012/0233882 A1 9/2012 Huffa et al.
2012/0234052 A1 9/2012 Huffa et al.
2012/0240429 A1 9/2012 Sokolowski et al.
2012/0246973 A1* 10/2012 Dua ..... A43B 23/0235 36/83
2012/0255201 A1 10/2012 Little
2012/0279260 A1 11/2012 Dua et al.
2012/0291314 A1 11/2012 Sokolowski et al.
2012/0297643 A1* 11/2012 Shaffer ..... A43B 1/0027 36/83
2013/0019500 A1* 1/2013 Greene ..... A43B 23/025 36/50.1
2013/0025157 A1* 1/2013 Wan ..... A43B 7/06 36/45
2013/0055590 A1* 3/2013 Mokos ..... A43B 1/04 36/45
2013/0081307 A1* 4/2013 del Biondi ..... A43B 3/0036 36/83
2013/0125420 A1 5/2013 Raghuprasad
2013/0174446 A1 7/2013 Antonelli et al.
2013/0211492 A1 8/2013 Schneider
2013/0219636 A1* 8/2013 Dojan ..... A43B 23/0235 12/142 R
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269159 A1 10/2013 Robitaille et al.
2013/0269209 A1* 10/2013 Lang ..... A43B 23/0205 36/45
2013/0269212 A1 10/2013 Little
2013/0291293 A1 11/2013 Jessiman et al.
2013/0304232 A1 11/2013 Gries
2013/0305465 A1* 11/2013 Siegismund ..... A43B 9/12 12/146 C
2013/0305911 A1 11/2013 Masson et al.
2013/0312284 A1* 11/2013 Berend ..... A43B 1/0027 36/84
2014/0000043 A1 1/2014 Boardman et al.
2014/0007458 A1 1/2014 Berger et al.
2014/0068838 A1 3/2014 Beers et al.
2014/0070042 A1 3/2014 Beers et al.
2014/0082905 A1 3/2014 Wen
2014/0082963 A1 3/2014 Beers
2014/0088688 A1 3/2014 Lilburn et al.
2014/0109441 A1 4/2014 McDowell et al.
2014/0130372 A1* 5/2014 Aveni ..... A43B 3/122 36/83
2014/0134405 A1 5/2014 Yang
2014/0137433 A1 5/2014 Craig
2014/0137434 A1 5/2014 Craig
2014/0150292 A1 6/2014 Podhajny et al.
2014/0173932 A1* 6/2014 Bell ..... A43B 1/04 36/84
2014/0173934 A1 6/2014 Bell
2014/0173935 A1 6/2014 Sabbioni
2014/0182447 A1 7/2014 Kang et al.
2014/0189964 A1 7/2014 Wen et al.
2014/0196316 A1 7/2014 Follet
2014/0215850 A1 8/2014 Redl et al.
2014/0237854 A1 8/2014 Fallon
2014/0245633 A1 9/2014 Podhajny
2014/0259760 A1* 9/2014 Dojan ..... A43B 23/026 36/45
2014/0310983 A1* 10/2014 Tamm ..... A43B 23/0245 36/83
2014/0310984 A1 10/2014 Tamm et al.
2014/0310987 A1 10/2014 Sokolowski et al.
2014/0338222 A1* 11/2014 Song ..... A43B 23/0235 36/45
2014/0352173 A1 12/2014 Bell et al.
2014/0373389 A1* 12/2014 Bruce ..... A43B 23/0215 36/87
2014/0377488 A1* 12/2014 Jamison ..... A43B 1/04 428/36.1
2015/0007451 A1 1/2015 Bruce
2015/0013187 A1 1/2015 Taniguchi et al.
2015/0052778 A1 2/2015 Kirk et al.
2015/0075031 A1 3/2015 Podhajny et al.
2015/0143716 A1* 5/2015 Long ..... A43B 1/04 36/83
2015/0143720 A1* 5/2015 Avar ..... A43B 23/08 36/107
2015/0201705 A1 7/2015 Doremus et al.
2015/0201707 A1 7/2015 Bruce
2015/0202915 A1* 7/2015 Lee ..... B44C 1/105 428/41.8
2015/0272274 A1 10/2015 Berns et al.
2015/0282564 A1 10/2015 Meschter et al.
2015/0282565 A1 10/2015 Kilgore
2015/0305442 A1* 10/2015 Ravindran ..... A43B 23/28 36/138
2015/0313316 A1 11/2015 Boucher et al.
2015/0320139 A1 11/2015 Peitzker
2015/0342286 A1* 12/2015 Huffman ..... A43B 1/04 36/9 R
2015/0374064 A1 12/2015 Pierobon
2016/0021979 A1 1/2016 Iuchi et al.
2016/0029736 A1 2/2016 Meir
2016/0058100 A1 3/2016 Dealey et al.
2016/0076178 A1 3/2016 Head et al.
2016/0088899 A1 3/2016 Liles et al.
2016/0095377 A1* 4/2016 Tamm ..... A43B 3/0036 36/9 R
2016/0106182 A1 4/2016 Yun
2016/0166000 A1 6/2016 Bruce et al.
2016/0166007 A1 6/2016 Bruce et al.
2016/0166010 A1 6/2016 Bruce et al.
2016/0168774 A1 6/2016 Breithaupt et al.
2016/0174660 A1* 6/2016 Iuchi ..... A43B 1/04 36/45

(56) References Cited

U.S. PATENT DOCUMENTS

| | | | | |
|---|---|---|---|---|
| 2016/0185062 | A1 | 6/2016 | Boucher et al. | |
| 2016/0208421 | A1 | 7/2016 | Baines et al. | |
| 2016/0213095 | A1 | 7/2016 | Kohatsu et al. | |
| 2016/0286898 | A1 | 10/2016 | Manz et al. | |
| 2016/0345675 | A1 | 12/2016 | Bruce et al. | |
| 2016/0345676 | A1 | 12/2016 | Bruce et al. | |
| 2016/0345677 | A1 | 12/2016 | Bruce et al. | |
| 2017/0035149 | A1 | 2/2017 | Bruce et al. | |
| 2017/0265596 | A1 | 9/2017 | Bruce et al. | |
| 2017/0325545 | A1 | 11/2017 | Becker et al. | |
| 2017/0325546 | A1 | 11/2017 | Becker et al. | |
| 2018/0242689 | A1 | 8/2018 | Bruce et al. | |
| 2018/0343962 | A1 | 12/2018 | Bruce et al. | |
| 2018/0343963 | A1 | 12/2018 | Bruce et al. | |
| 2018/0368506 | A1 | 12/2018 | Bruce et al. | |
| 2019/0014854 | A1 | 1/2019 | Santos et al. | |
| 2019/0150552 | A1* | 5/2019 | Casillas ..... | A43B 1/04 |
| 2019/0231031 | A1 | 8/2019 | Bruce et al. | |
| 2019/0254386 | A1 | 8/2019 | Bruce et al. | |
| 2020/0146390 | A1 | 5/2020 | Heidenfelder et al. | |

FOREIGN PATENT DOCUMENTS

| | | | |
|---|---|---|---|
| CN | 1121403 | A | 5/1996 |
| CN | 1883325 | A | 12/2006 |
| CN | 2930360 | Y | 8/2007 |
| CN | 201175007 | Y | 1/2009 |
| CN | 201356120 | Y | 12/2009 |
| CN | 101627843 | A | 1/2010 |
| CN | 101801229 | A | 8/2010 |
| CN | 102271548 | A | 12/2011 |
| CN | 102497793 | A | 6/2012 |
| CN | 202536202 | U | 11/2012 |
| CN | 202635759 | U | 1/2013 |
| CN | 102987631 | A | 3/2013 |
| CN | 202950101 | U | 5/2013 |
| CN | 103415657 | A | 11/2013 |
| CN | 203369442 | U | 1/2014 |
| CN | 103653542 | A | 3/2014 |
| CN | 203676256 | U | 7/2014 |
| CN | 20403521 | U | 12/2014 |
| CN | 104185431 | A | 12/2014 |
| DE | 726634 | C | 10/1942 |
| DE | 1 140 107 | B | 11/1962 |
| DE | 4306286 | A1 | 9/1993 |
| DE | 19809085 | A1 | 8/1999 |
| DE | 102011011185 | A1 | 8/2012 |
| DE | 102011119245 | A1 | 10/2012 |
| DE | 102012020216 | A1 | 4/2014 |
| EP | 0372370 | A2 | 6/1990 |
| EP | 1486601 | A1 | 12/2004 |
| EP | 2 567 631 | A1 | 3/2013 |
| EP | 2657384 | A1 | 10/2013 |
| EP | 2792261 | A1 | 10/2014 |
| EP | 2792264 | A1 | 10/2014 |
| EP | 2811056 | A1 | 12/2014 |
| EP | 3011855 | A2 | 4/2016 |
| FR | 1 012 719 | A | 7/1952 |
| GB | 430805 | A | 6/1935 |
| GB | 477556 | A | 1/1938 |
| GB | 1083849 | | 9/1967 |
| GB | 1299353 | | 12/1972 |
| JP | S551107964 | U1 | 2/1950 |
| JP | H07054250 | A | 2/1995 |
| JP | H0733076 | B2 | 4/1995 |
| JP | H07216703 | A | 8/1995 |
| JP | 8-109553 | A | 4/1996 |
| JP | 09322810 | A | 12/1997 |
| JP | H10158965 | A | 6/1998 |
| JP | 2001030361 | A | 2/2001 |
| JP | 2004105323 | A | 4/2004 |
| JP | 2004339651 | A | 12/2004 |
| JP | 20050422266 | A | 2/2005 |
| JP | 2005-102933 | A | 4/2005 |
| JP | 2005-160697 | A | 6/2005 |
| JP | 2006009175 | A | 1/2006 |
| JP | 2006161167 | A | 6/2006 |
| JP | 2008240187 | A | 10/2008 |
| JP | 2005290628 | A1 | 10/2015 |
| KR | 20020038168 | B1 | 5/2002 |
| KR | 100737426 | B1 | 7/2007 |
| TW | 201105521 | A | 2/2011 |
| WO | 98/24616 | A1 | 6/1998 |
| WO | 00007475 | A1 | 2/2000 |
| WO | WO 0036943 | A1 | 6/2000 |
| WO | 2009000371 | A1 | 12/2008 |
| WO | 00303016036 | A2 | 12/2009 |
| WO | 2010080182 | A1 | 7/2010 |
| WO | 2010/100488 | A1 | 9/2010 |
| WO | 2011028444 | A1 | 3/2011 |
| WO | 2011082391 | A1 | 7/2011 |
| WO | 2011/111564 | A1 | 9/2011 |
| WO | 2011126837 | A2 | 10/2011 |
| WO | 2011137405 | A1 | 11/2011 |
| WO | WO 2013071679 | A1 | 5/2013 |
| WO | 2013126313 | A2 | 8/2013 |
| WO | 2014134244 | A1 | 9/2014 |
| WO | 2014/209594 | A1 | 12/2014 |
| WO | 2014/209596 | A1 | 12/2014 |
| WO | 2014209594 | A1 | 12/2014 |
| WO | 2016093961 | A1 | 6/2016 |
| WO | 2016191478 | A1 | 12/2016 |

OTHER PUBLICATIONS

International Search Report and Written Opinion dated Sep. 23, 2014 in PCT/US2014/041669.

Australian Office Action dated May 28, 2016 for Australian Patent Application No. 2014303040, 6 Pages.

Australian Office Action dated May 28, 2016 for Australian Patent Application No. 2014303042, 5 Pages.

Non-Final Office Action dated Aug. 19, 2016 for U.S. Appl. No. 14/163,438, 15 pages.

Branscomb et al., "New Directions in Braiding", Journal of Engineered Fibers and Fabrics, vol. 8, Issue 2-2013 Braiding, Journal of Engineered Fibers and Fabrics, vol. 8, Issue 2-2013—http://www.jeffournal.org, pp. 11-24.

International Search Report and Written Opinion dated Sep. 19, 2014 in PCT/US2014/041659. 10 pages.

International Search Report and Written Opinion dated Sep. 23, 2014 in International Patent Application No. PCT/US2014/041669. 10 pages.

International Search Report and Written Opinion dated Sep. 23, 2016 in International Patent Application No. PCT/2016/034109, 18 pages.

International Search Report and Written Opinion dated Jan. 12, 2017 in International Patent Application No. PCT/2016/045313, 15 pages.

International Search Report and Written Opinion dated Aug. 19, 2016 for International Patent Application No. PCT/US2016/034107, 17 pages.

Final Office Action dated Dec. 9, 2016 in U.S. Appl. No. 14/565,598, 17 pages.

Non-Final Office Action dated Jan. 17, 2017 in U.S. Appl. No. 14/721,507, 12 pages.

Final Office Action dated Feb. 16, 2017 in U.S. Appl. No. 14/163,438, 17 pages.

Final Office Action dated Feb. 23, 2017 in U.S. Appl. No. 14/495,252, 15 pages.

http://www.apparelsearch.com/definitions/miscellaneous/braiding.htm.

Non-Final Office Action dated Jun. 1, 2016 for U.S. Appl. No. 14/565,568, 5 pages.

Non-Final Office Action dated Jul. 1, 2016 in U.S. Appl. No. 14/565,598, 10 pages.

International Search Report and Written Opinion dated Apr. 4, 2016 for International Patent Application No. PCT/US2015055902, 17 pages.

(56) References Cited

OTHER PUBLICATIONS

International Search Report and Written Opinion dated Jun. 16, 2016 in International Patent Application No. PCT/US2015/055868, 11 pages.
International Preliminary Report on Patentability dated Jun. 22, 2017 in International Patent Application No. PCT/US2015/056533, 6 pages.
International Preliminary Report on Patentability dated Jun. 22, 2017 in International Patent Application No. PCT/US2015/055868, 10 pages.
International Preliminary Report on Patentability dated Jun. 22, 2017 in International Patent Application No. PCT/US2015/055902, 10 pages.
Canadian Examiner's Report dated Jun. 28, 2017 in Canadian Patent Application No. 2,910,349, 3 pages.
Canadian Examiner's Report dated Jun. 13, 2017 in Canadian Patent Application No. 2,910,350, 3 pages.
Non-Final Office Action dated Aug. 23, 2017 in U.S. Appl. No. 14/565,598, 15 pages.
Non-Final Office Action dated Sep. 14, 2017 in U.S. Appl. No. 14/820,822, 14 pages.
Non-Final Office Action dated Jun. 22, 2017 in U.S. Appl. No. 14/495,252, 13 pages.
European Search Report dated Mar. 14, 2017 for European Patent Application No. 16001887.5, 9 pages.
Canadian Examiner's Report dated Sep. 19, 2016 in Canadian Patent Application No. 2,910,349, 3 pages.
Office Action dated Jun. 22, 2016 in U.S. Appl. No. 14/495,252, 13 pages.
Office Action dated Feb. 12, 2018 in Australian Patent Application No. 2015361198, 3 pages.
Non-Final Office Action dated Mar. 7, 2018 in U.S. Appl. No. 14/721,450, 7 pages.
Non-Final Office Action dated Mar. 29, 2018 in U.S. Appl. No. 14/495,252, 14 pages.
Non-Final Office Action dated May 10, 2018 in U.S. Appl. No. 14/565,598, 17 pages.
Final Office Action dated Aug. 14, 2017 in U.S. Appl. No. 14/721,507, 12 pages.
Non-Final Office Action dated Oct. 19, 2017 in U.S. Appl. No. 14/163,438, 18 pages.
Final Office Action dated Nov. 1, 2017 in U.S. Appl. No. 14/495,252, 14 pages.
Office Action dated Nov. 24, 2017 in Australian Patent Application No. 2015361198, 3 pages.
International Preliminary Report on Patentability dated Dec. 7, 2017 in International Patent Application No. PCT/US2016/034109, 11 pages.
International Preliminary Report on Patentability dated Dec. 7, 2017 in International Patent Application No. PCT/US2016/034107, 8 pages.
Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
Final Office Action dated Apr. 25, 2019 in U.S. Appl. No. 14/820,822, 15 pages.
Partial search report dated Apr. 26, 2019 in European Patent Application No. 18202740.9, 13 pages.
Final Office Action dated May 1, 2019 in U.S. Appl. No. 14/721,450, 6 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Non-Final Office Action dated Jul. 9, 2019 in U.S. Appl. No. 14/721,450, 6 pages.
International Search Report and Written Opinion dated Sep. 10, 2018 in International Patent Application No. PCT/US2018/035404, 13 pages.
Final Office Action dated Sep. 11, 2018 in U.S. Appl. No. 14/495,252, 14 pages.
Non-Final Office Action dated Sep. 18, 2018 in U.S. Appl. No. 15/613,983, 7 pages.
Non-Final Office Action dated Oct. 1, 2018 in U.S. Appl. No. 14/820,822, 15 pages.
Decision to grant a European patent pursuant to Article 97(1) dated Nov. 8, 2018 in European Patent Application No. 14737100.9, 1 page.
Communication pursuant to Article 94(3) dated Nov. 22, 2018 in European Patent Application No. 16731401.2, 5 pages.
Communication pursuant to Article 94(3) dated Nov. 23, 2018 in European Patent Application No. 15787425.6, 7 pages.
Final Office Action dated Dec. 14, 2018 in U.S. Appl. No. 14/565,598, 22 pages.
Non-Final Office Action dated Dec. 28, 2018 in U.S. Appl. No. 14/721,450, 6 pages.
Notice of Allowance dated Jan. 11, 2019 in U.S. Appl. No. 15/613,983, 7 pages.
Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Notice of Allowance dated Sep. 16, 2019 in U.S. Appl. No. 14/721,450, 9 pages.
Extended Search Report dated Nov. 29, 2019 in European Patent Application No. 19192467.9, 5 pages.
Partial search report dated Dec. 9, 2019 in European Patent Application No. 19191026.4, 15 pages.
International Preliminary Report on Patentability dated Dec. 12, 2019 in International Patent Application No. PCT/US2018/035417, 8 pages.
International Preliminary Report on Patentability dated Dec. 12, 2019 in International Patent Application No. PCT/US2018/035408, 10 pages.
International Search Report and Written Opinion dated Apr. 15, 2019 in International Patent Application No. PCT/US2018/061502, 18 pages.
Non-Final Office Action dated Oct. 29, 2019 in U.S. Appl. No. 14/820,822, 15 pages.
Non-Final Office Action dated Nov. 1, 2019 in U.S. Appl. No. 14/565,598, 18 pages.
Final Office Action received for U.S. Appl. No. 14/163,438, dated Jan. 13, 2020, 12 pages.
Non-Final Office Action received for U.S. Appl. No. 15/993,195, dated Feb. 6, 2020, 16 pages.
International Search Report and Written Opinion received for PCT Patent Application No. PCT/US2019/036495, dated Nov. 8, 2019, 20 pages.
Non-Final Office Action received for U.S. Appl. No. 15/993,180, dated Apr. 6, 2020, 12 pages.
Summons to Attend Oral Proceedings received for European Patent Application No. 16001887.5, dated Dec. 2, 2019, 5 pages.
Final Office Action received for U.S. Appl. No. 14/820,822, dated Jun. 9, 2020, 18 pages.
Final Office Action received for U.S. Appl. No. 15/993,180, dated Jun. 12, 2020, 15 pages.
Non-Final Office Action received for U.S. Appl. No. 14/163,438, dated Jun. 25, 2020, 14 pages.
Non-Final Office Action received for U.S. Appl. No. 16/192,129, dated Jun. 12, 2020, 10 pages.
Notice of Allowance received for U.S. Appl. No. 15/993,195, dated Jun. 5, 2020, 5 pages.
Office Action received for Canadian Patent Application No. 3020031, dated Jun. 5, 2020, 5 pages.
Office Action received for Indian Patent Application No. 201747019912, dated Jun. 16, 2020, 5 pages.
Office Action received for Indian Patent Application No. 201747019980, dated Jun. 16, 2020, 5 pages.

(56) References Cited

OTHER PUBLICATIONS

International Preliminary Report on Patentability received for PCT Patent Application No. PCT/US2018/061502, dated Jun. 4, 2020, 10 pages.
Non-Final Office Action received for U.S. Appl. No. 15/940,234, dated May 29, 2020, 12 pages.
International Preliminary Report on Patentability received for PCT Patent Application No. PCT/US2018/035404, dated Dec. 12, 2019, 8 pages.
Office Action received for European Patent Application No. 15787425.6, dated Jan. 23, 2020, 6 pages.
Extended European Search Report received for European Patent Application No. 19191026.4, dated Mar. 12, 2020, 12 pages.
Office Action received for European Patent Application No. 16727106.3, dated Apr. 8, 2020, 6 pages.
Notice of Allowance received for U.S. Appl. No. 14/565,598, dated Mar. 16, 2020, 8 pages.
Non-Final Office Action received for U.S. Appl. No. 15/993,190, dated May 7, 2020, 11 pages.
Notice of Allowance received for U.S. Appl. No. 15/903,542, dated May 8, 2020, 9 pages.
Final Office Action dated Jun. 4, 2018 in U.S. Appl. No. 14/820,822, 14 pages.
Final Office Action dated Jul. 13, 2018 in U.S. Appl. No. 14/163,438, 14 pages.
Final Office Action dated Aug. 27, 2018 in U.S. Appl. No. 14/721,450, 8 pages.
Non-Final Office Action received for U.S. Appl. No. 16/404,286, dated Jul. 22, 2020, 5 pages.
Intention to Grant received for European Patent Application No. 16001887.5, dated Jul. 28, 2020, 7 pages.
Office Action received for European Patent Application No. 15787425.6, dated Aug. 5, 2020, 6 pages.

* cited by examiner

ARTICLE OF FOOTWEAR HAVING MULTIPLE BRAIDED STRUCTURES

CROSS-REFERENCE TO RELATED APPLICATIONS

This application is a continuation-in-part of U.S. patent application Ser. No. 14/163,438, filed Jan. 24, 2014, and titled "Braided Upper With Overlays For Article Of Footwear", the entirety of which is herein incorporated by reference and referred to throughout the detailed description as the "Braided Upper" application, which claims priority to U.S. Provisional Patent Application 61/839,097, filed Jun. 25, 2013, and titled "Article of Footwear with Braided Upper", the entirety of which is herein incorporated by reference and referred to throughout the detailed description as the "Provisional Braided Upper" application. This application is also related to U.S. patent application Ser. No. 14/495,252, filed Sep. 24, 2014, and titled "Article of Footwear With Braided Upper", the entirety of which is herein incorporated by reference, which claims priority to U.S. patent application Ser. No. 14/163,392, filed Jan. 24, 2014, and also titled "Article of Footwear with Braided Upper" the entirety of which is herein incorporated by reference, which claims priority to U.S. Provisional Patent Application 61/839,097, filed Jun. 25, 2013, and titled "Article of Footwear with Braided Upper".

BACKGROUND

The present embodiments relate to articles of footwear and in particular to uppers for articles of footwear.

Athletic shoes often have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

SUMMARY

In one aspect, an article of footwear includes an upper and a sole system, where the upper includes a first braided structure, a second braided structure, and an overlay system. The overlay system is bonded to the first braided structure and the overlay system is bonded to the second braided structure. The overlay system is more resistant to stretching than the first braided structure and the overlay system is more resistant to stretching than the second braided structure.

In another aspect, an article of footwear includes an upper and a sole system. The upper includes a first braided structure, a second braided structure, a member, and an overlay system. The overlay system is bonded to the first braided structure and the overlay system is bonded to the second braided structure. The member is positioned between the first braided structure and the second braided structure.

In another aspect, an upper for an article of footwear includes a first braided structure including a first opening edge. The upper further includes a second braided structure including a second opening edge, the second opening edge being substantially aligned with the first opening edge. Additionally, the upper includes an overlay system including a first layer and a second layer. The first layer is bonded to the first opening edge. The second layer is bonded to the second opening edge.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
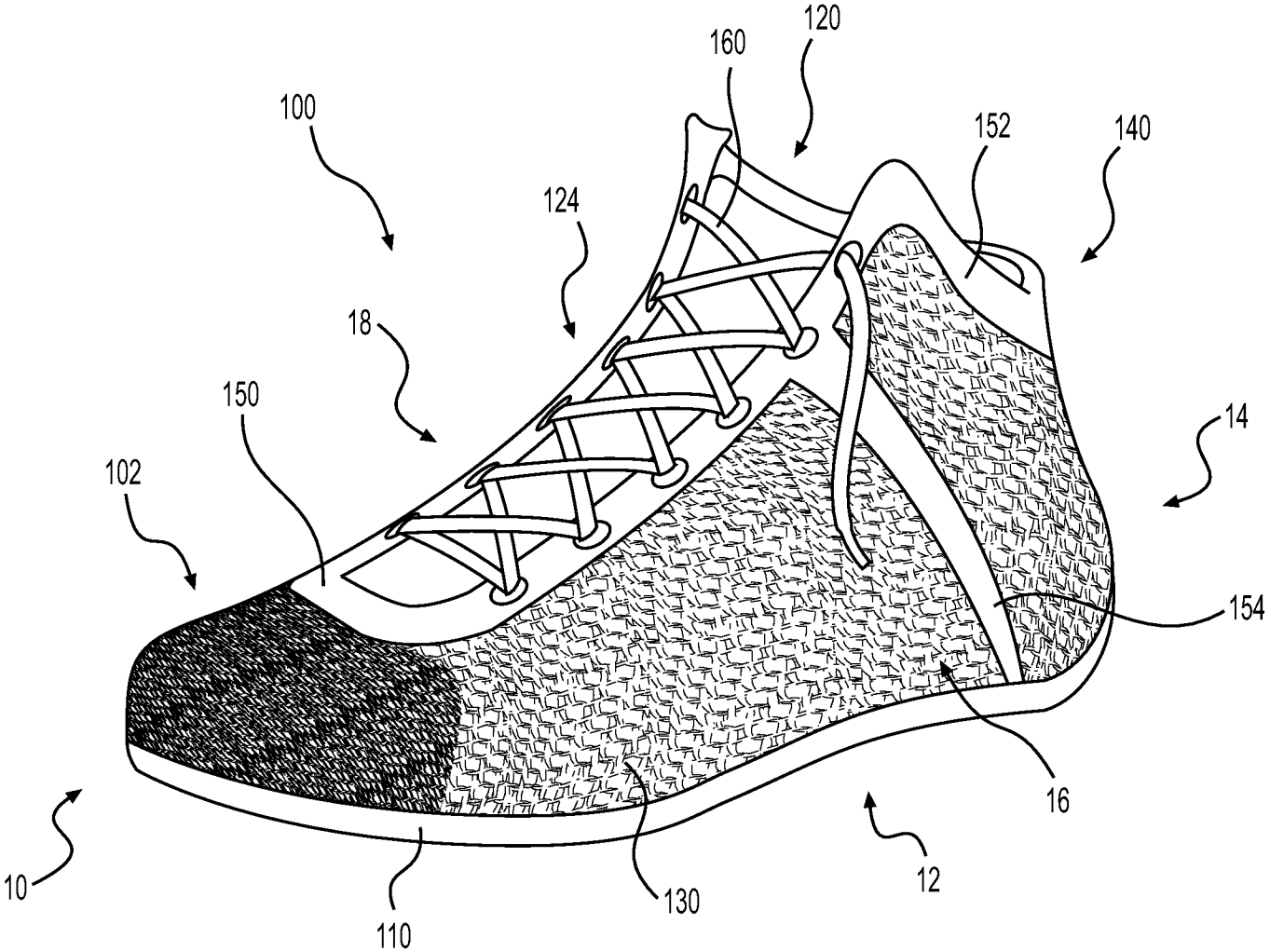
FIG. 1 is a schematic isometric view of an embodiment of an article of footwear including a braided upper with overlays.

FIG. 1 is an isometric view of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

In some embodiments, article of footwear 100 may include upper 102 and sole system 110. Sole system 110 is secured to upper 102 and extends between the foot and the ground when article 100 is worn. In different embodiments, sole system 110 may include different components. For example, sole system 110 may include an outsole, a midsole, and/or an insole. In some cases, one or more of these components may be optional.

Sole system 110 may provide one or more functions for article 100. For example, in some embodiments, sole system 110 may be configured to provide traction for article 100. In addition to providing traction, sole system 110 may attenuate ground reaction forces when compressed between the foot and the ground during walking, running or other ambulatory activities. The configuration of sole system 110 may vary significantly in different embodiments to include a variety of conventional or non-conventional structures. In some cases, the configuration of sole system 110 can be selected according to one or more types of ground surfaces on which sole system 110 may be used. Examples of ground surfaces include, but are not limited to: natural turf, synthetic turf, dirt, as well as other surfaces.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Referring to FIG. 1, for purposes of reference, components of article 100, such as upper 102, may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, upper 102 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of upper 102. Likewise, lateral side 16 and medial side 18 are intended to represent generally two sides of upper 102, rather than precisely demarcating upper 102 into two halves.

For consistency and convenience, directional adjectives are employed throughout this detailed description corresponding to the illustrated embodiments. The term "longitudinal" as used throughout this detailed description and in the claims refers to a direction extending a length of a component. For example, the longitudinal direction of upper 102 may extend from forefoot portion 10 to heel portion 14 of upper 102. Also, the term "lateral" as used throughout this detailed description and in the claims refers to a direction extending along a width of a component. For example, the lateral direction of upper 102 may extend between medial side 18 and lateral side 16 of upper 102. Additionally, the term "vertical" as used throughout this detailed description and in the claims refers to a direction that is perpendicular to both the longitudinal and lateral directions.

In addition, the term "proximal" refers to a portion of a footwear component that is closer to a portion of a foot when an article of footwear is worn. Likewise, the term proximal direction refers to a direction oriented towards a foot when an article is word. The term "distal" refers to a portion of a footwear component that is further from a portion of a foot when an article of footwear is worn. The distal direction refers to a direction oriented away from a foot when an article is worn.

In some embodiments, upper 102 may be comprised of a braided structure, such as a braided fabric or other braided structure. Braided structures can be formed by intertwining three or more strands of yarn, filaments or other fibers to form the structure. As an example, upper 102 as seen in FIG. 1 is formed from a plurality of strands 130 that are braided together to form a shape that is globally similar to the shape of a foot.

Braiding can be used to form three-dimensional structures, by braiding strands of yarn over a form or a last. Strands of the braided structure, such as plurality of strands 130 of the exemplary embodiment, can be fabricated from fibers such as nylon, carbon, polyurethane, polyester, cotton, aramid (e.g., Kevlar®), polyethylene or polypropylene. These strands can be braided to form three-dimensional structures for a wide variety of applications.

Braided structures may be fabricated manually, or may be manufactured using automated braiding machinery, such as the machinery disclosed in U.S. Pat. Nos. 7,252,028; 8,261,648; 5,361,674; 5,398,586; and 4,275,638, all of which are incorporated by reference in their entirety herein. Such three-dimensional braided structures may also be manufactured to a specific design by, for example, TEF Braids, Warrensburg, N.Y. or A&P Technology, Cincinnati, Ohio.

By using braiding, uppers for articles of footwear may be engineered with specific features tailored to a particular athletic or recreational activity. Braided uppers can be very light while conforming closely and comfortably to the wearer's feet. In some embodiments, the fit of the upper may be adjusted to provide the specific degree of tension or tightness the wearer may prefer. Braided uppers are characterized by close containment over the wearer's foot. In some embodiments, the braided fabric may wrap all the way around the footwear, as shown in the figures. Such a structure has tensional integrity or "tensegrity," since the wearer's foot is in compression, while the braided strands are in tension around the wearer's foot.

Some embodiments may include braided uppers that extend beneath the foot, thereby providing 360 degree coverage at some regions of the foot. However, other embodiments need not include uppers that extend beneath the foot. In other embodiments, for example, a braided upper could have a lower periphery joined with a sole structure and/or sock liner.

Figure 2:
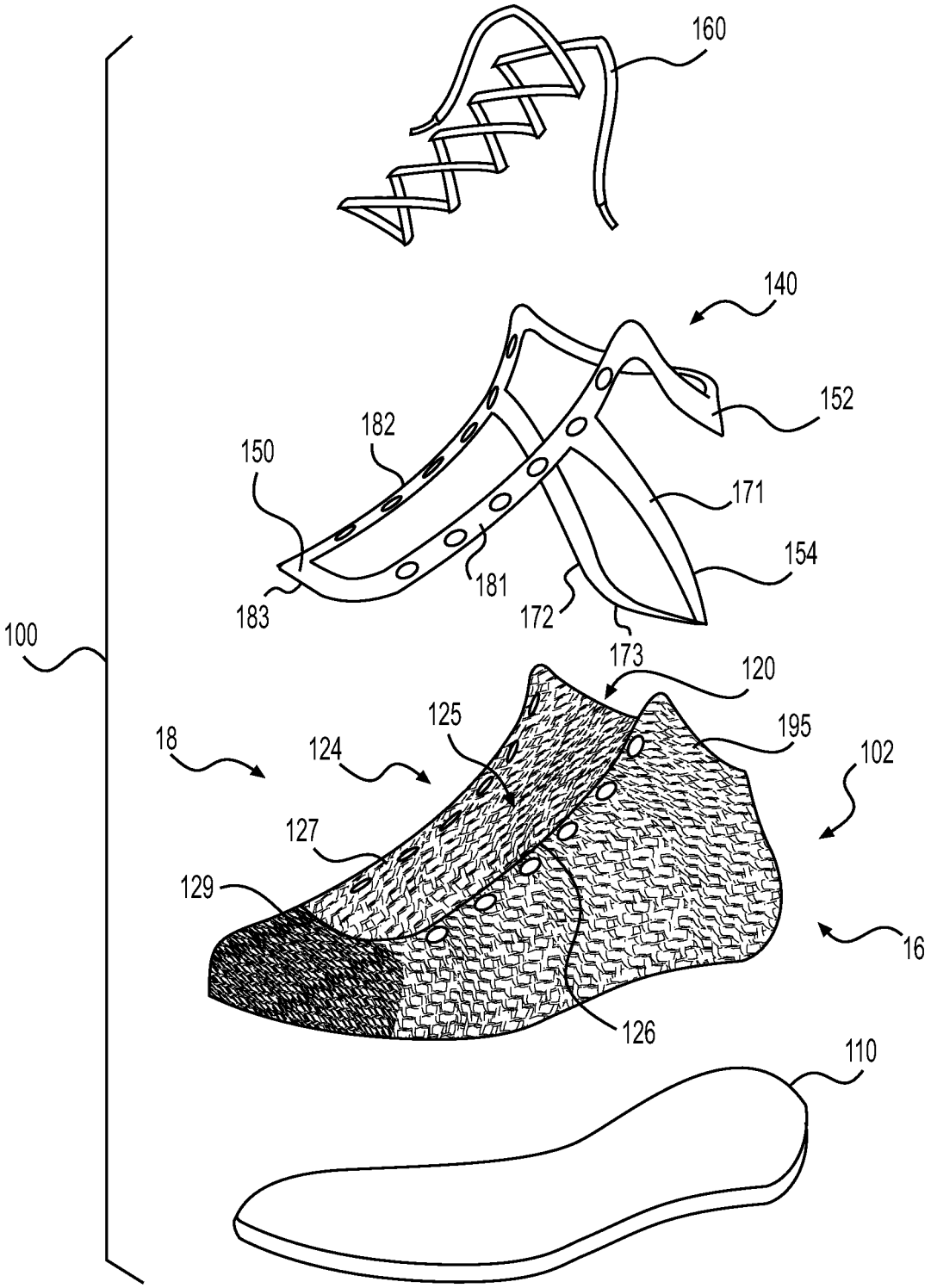
FIG. 2 is an exploded isometric view of the article of footwear of FIG. 1.

FIG. 2 illustrates an exploded isometric view of an embodiment of article 100, including upper 102 which is comprised of a braided structure. Referring to FIGS. 1-2, upper 102 is seen to have an opening 120 that may receive a foot. Additionally, upper 102 has a fastening region 124. Fastening region 124 may further include a fastening gap 125 that separates a lateral fastening edge 126 from a medial fastening edge 127 (see FIG. 2).

Fastening region 124 may be further associated with that a fastening member 160. In the exemplary embodiment, fastening member 160 may be a lace. In other embodiments, however, fastening member 160 could be any other kind of fastener including but not limited to, straps, snaps, buttons, zippers, hook and loop fasteners (e.g., VELCRO®, a type of hook and loop fastener), as well as other kinds of fasteners.

Embodiments utilizing braided uppers can include provisions to help provide additional structure to the upper. In some embodiments, for example, an article may include one or more additional material portions that are bonded or otherwise attached to specific portions of the braided upper in order to enhance various characteristics of the upper. For example, these material portions may be used to increase strength and durability, provide stretch resistance at certain locations of the upper and facilitate the joining of other components with the braided structure.

Throughout the detailed description and in the claims, the term "overlay portion", or simply overlay, refers to any portion of material that is attached to a surface of a braided structure, such as a braided upper. In some embodiments, an overlay portion is comprised of a distinct material from the strands of the braided structure. Moreover, in some embodiments, an overlay portion may have substantially different material characteristics from the strands of the braided structure. In an exemplary embodiment, an overlay portion may resist stretching in comparison to a corresponding portion of a braided structure.

Generally, an overlay portion may be formed of any material. Exemplary materials include, but are not limited to: fabrics (including woven and non-woven fabrics), leathers (including natural and synthetic leathers), polymer materials, as well as other kinds of materials. In one embodiment, one or more overlay portions may be made of thermoplastic polyurethane (TPU).

In an exemplary embodiment, article 100 may be associated with overlay component 140. Overlay component 140 may be further comprised of several different overlay portions, including a first overlay portion 150, a second overlay portion 152 and a third overlay portion 154. Each overlay portion may be provided at a specific location on upper. For example, first overlay portion 150 may be associated with fastening region 124 of upper 102. Likewise, second overlay portion 152 may be associated with opening 120. Finally, third overlay portion 154 may be associated with heel portion 14 as well as portions of both lateral side 16 and medial side 18 of upper 102.

Referring now to FIG. 2, in some embodiments, first overlay portion 150 extends along the edges of fastening region 124. In particular, first overlay portion 150 includes a first section 181 that is associated with lateral fastening edge 126 of fastening region 124. Also, first overlay portion 150 includes a second section 182 that is associated with medial fastening edge 127 of fastening region 124. In some embodiments, an intermediate section 183 runs along a forward most edge 129 of fastening region 124 and joins first section 181 and second section 182 of first overlay portion 150.

With this configuration, first overlay portion 150 may form, or form part of, the lateral and medial eyestays for upper 102. In particular, first overlay portion 150 may facilitate the attachment of upper 102 with fastening member 160. As discussed in further detail below, the use of overlay portions along the edges of fastening region 124 may help to more evenly distribute the tensioning forces applied by fastening member 160 to upper 102.

In at least some embodiments, first overlay portion 150 may help finish the braided structure of upper 102 along lateral fastening edge 126, medial fastening edge 127 and forward most edge 129 of fastening region 124. Specifically, in embodiments where the strands of the braided structure may be open at any of lateral fastening edge 126, medial fastening edge 127 or forward most edge 129, first overlay portion 150 may help to bond, fuse or otherwise hold the ends of the strands in place in order to prevent unraveling of the strands along these edges.

In some embodiments, second overlay portion 152 extends along the edges of opening 120. In particular, second overlay portion 152 is associated with opening edge 195. In some embodiments, moreover, second overlay portion 152 is substantially continuous with first overlay portion 150, such that all of the edges of upper 102 associated with opening 120 and/or the opening at fastening region 124 are covered by first overlay portion 150 or second overlay portion 152.

This arrangement helps to finish opening edge 195 by bonding any open strands to second overlay portion 152. In addition, second overlay portion 152 may help reinforce opening 120, so that the braided structure in the vicinity of opening 120 may not be overly stretched. Such reinforcement may be especially useful at opening 120, since opening 120 may undergo a great deal of pulling and other stress as a user inserts and/or removes his or her foot.

In some embodiments, third overlay portion 154 may include a first section 171 that extends along lateral side 16 and a second section 172 that extends along medial side 18 of upper 102. Additionally, a third section 173 of third overlay portion 154 may extend beneath (e.g., on a lower side of) upper 102 at heel portion 14. In some embodiments, third section 173 joins first section 171 and second section 172 so that third overlay portion 154 wraps continuously around the sides and bottom of upper 102.

In some embodiments, first section 171 of third overlay portion 154 extends from, and is continuously formed with, first section 181 of first overlay portion 150. Additionally, in some embodiments, second section 172 of third overlay portion 154 extends from, and is continuously formed with, second section 182 of first overlay portion 150. Because third overlay portion 154 may act to reduce stretching along its length, this configuration may help increase support under the heel by resisting stretching of the upper between first overlay portion 150 (at the top of the foot) and the lower side 199 (see FIG. 8) of heel portion 14.

Figure 3:
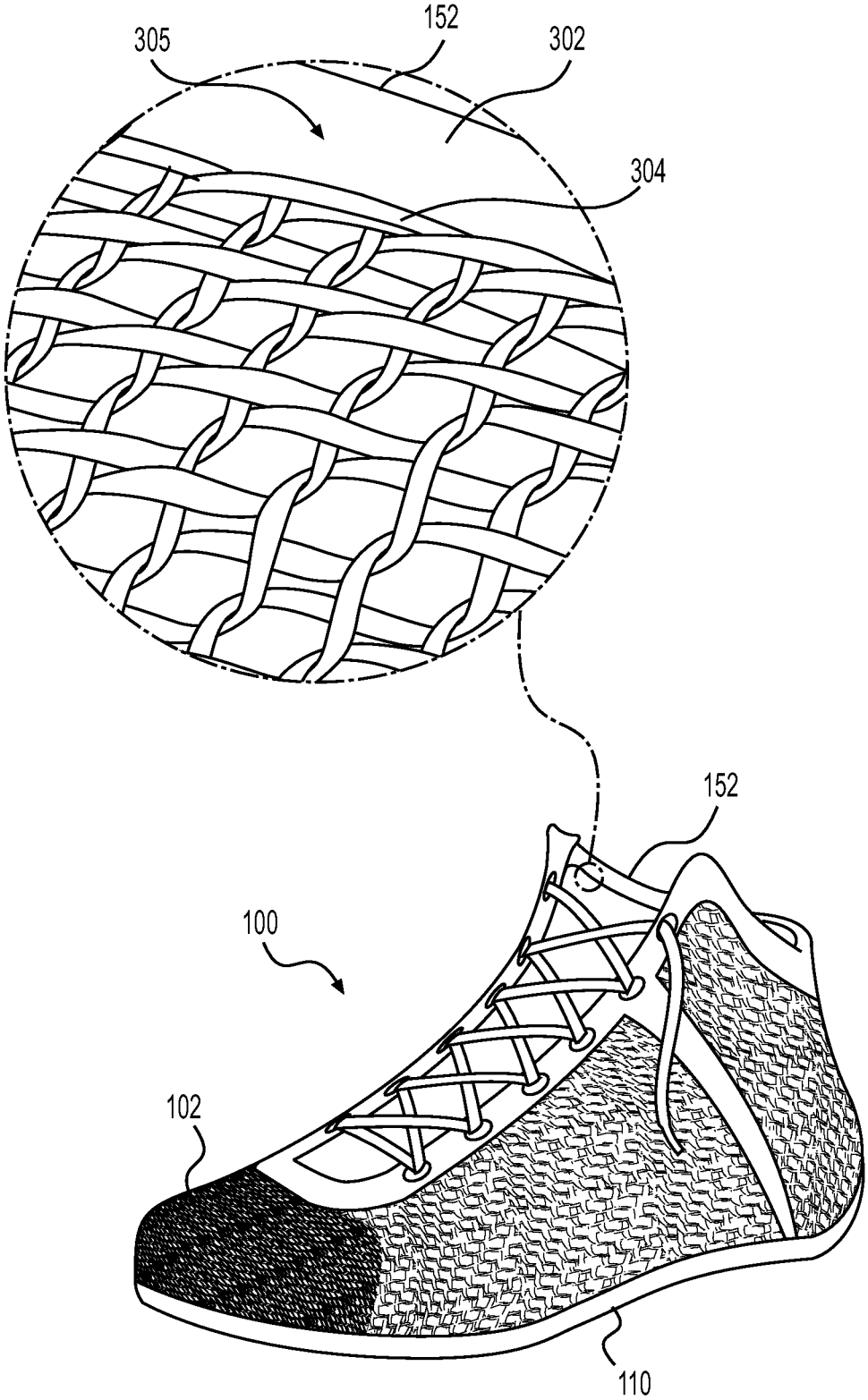
FIG. 3 is a schematic isometric view of the article of footwear of FIG. 1, including an enlarged view of strands disposed against the overlay.

FIG. 3 illustrates an enlarged view of a portion of article 100 where some strands may be bonded to a second overlay portion 152. Referring to FIG. 3, some strands 304 may be disposed against inner surface 302 second overlay portion 152. In this exemplary embodiment, strands 304 may form part of a closed woven edge 305 of upper 102 that lacks any loose or free ends of strands. In this case, strands 304 may be bonded to second overlay portion 152 to reinforce the continuously woven section of the braided structure.

Figure 4:
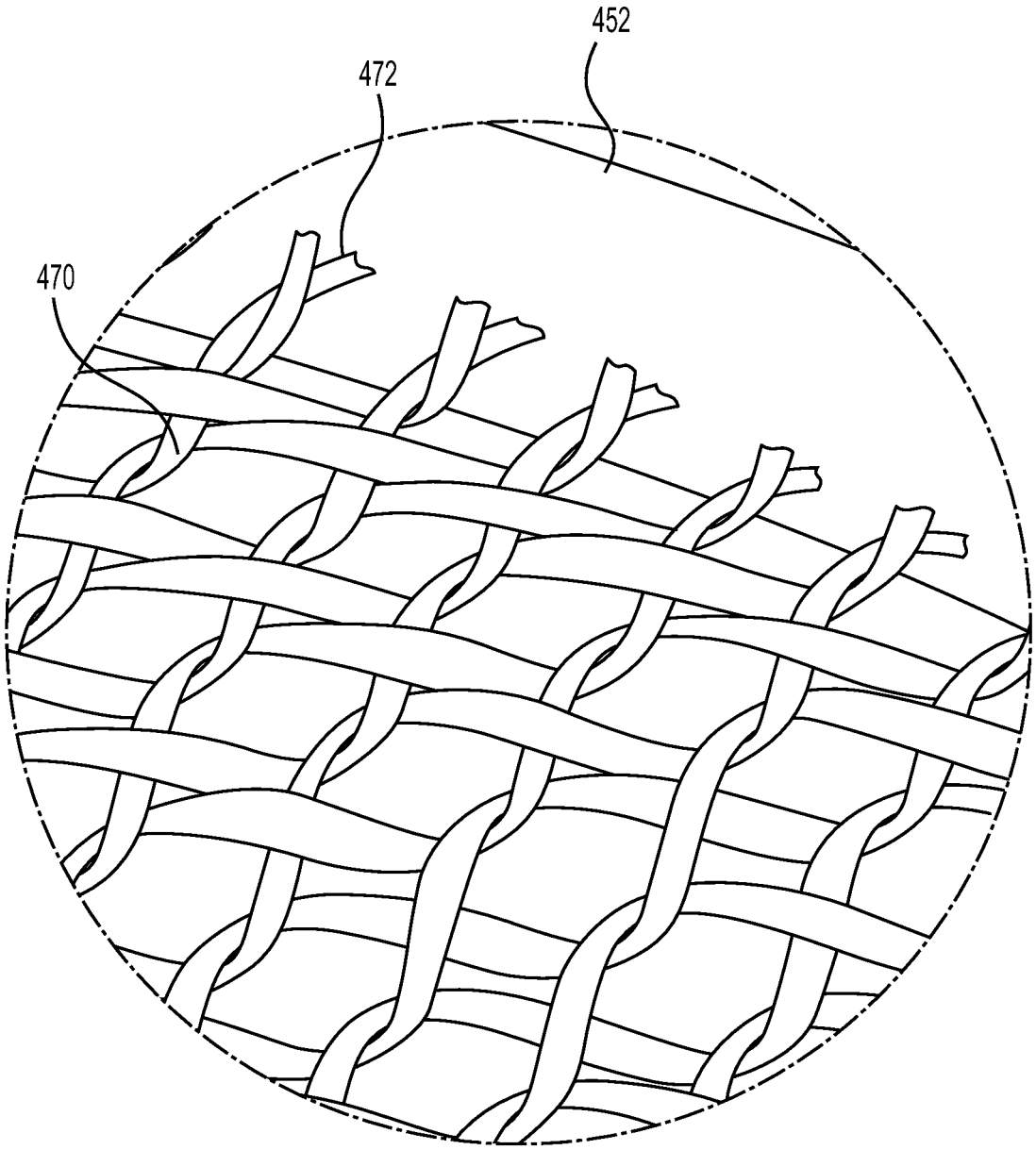
FIG. 4 is a schematic isometric view of another embodiment of an arrangement of strands bonded to an overlay.

In an alternative embodiment, shown in FIG. 4, some strands 470 may be configured with loose or free ends 472. In this configuration, open ends 472 may be secured to overlay portion 452 in order to keep strands 470 in place and help prevent strands 470 from loosening or unraveling. Thus it can be seen that in some embodiments, an overlay portion may be used to retain the loose or free ends associated with the edge of a braided structure. Such an arrangement may provide a means of finishing cut edges of the braided structure, or any edges that include loose or free ends that might unravel.

The arrangement described here provides an overlay portion that may act to reinforce the edge of the braided structure at opening 120. This may help reduce stretching of upper 102 at opening 120, in order to preserve the structural integrity of upper 102. In addition, second overlay portion 152 may help secure any loose or open ends of the braided structure to prevent fraying of the ends and/or unraveling of the braided structure.

Various processes for bonding an overlay portion to a braided structure, such as a braided upper, are discussed in further detail below. Exemplary materials used for bonding can include any known adhesives, melts, resins or other bonding agents.

Figure 5:
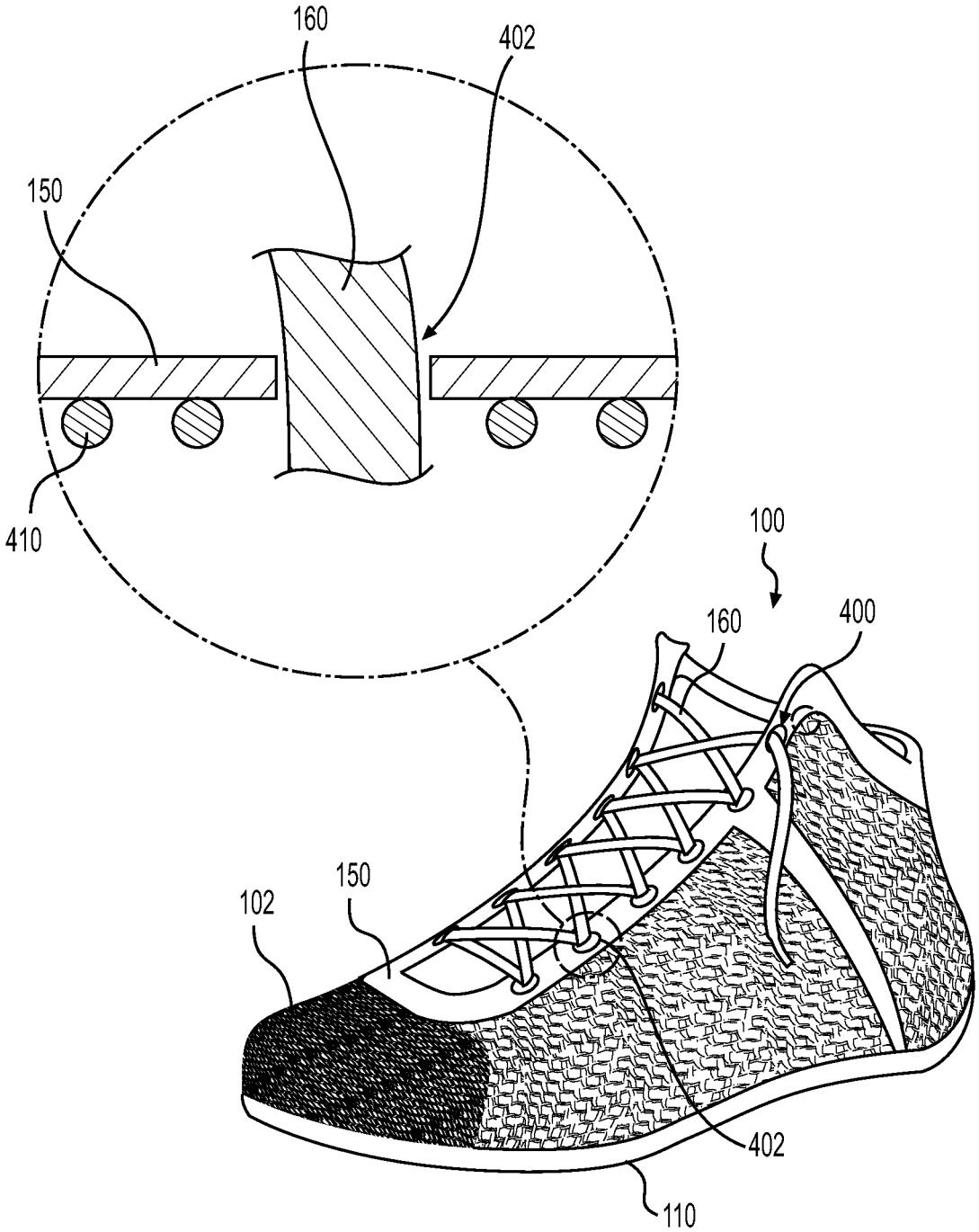
FIG. 5 is a schematic isometric view of the article of footwear of FIG. 1, including an enlarged cross-sectional view of an eyelet of the overlay.

FIG. 5 illustrates an isometric view of article 100, including an enlarged schematic cross-sectional view of a portion of first overlay portion 150 and fastening member 160. Referring to FIG. 5, first overlay portion 150 includes a plurality of eyelets 400. Specifically, plurality of eyelets 400, including eyelet 402 shown in the enlarged cross-section, are openings in first overlay portion 150 that are configured to receive portions of fastening member 160.

In contrast to an alternative embodiment where strands of upper 102 may directly secure portions of a fastening member, the exemplary embodiment is configured so that strands of upper 102 are indirectly secured to fastening member 160 via eyelets in first overlay portion 150. Specifically, strands 410 are seen to be secured directly to first overlay portion 150, while fastening member 160 is secured through plurality of eyelets 400 in first overlay portion 150. This configuration may distribute forces imparted by fastening member 160 more evenly across the braided structure of upper 102. This may prevent fastening member 160 from tugging too much on a particular strand, for example, thereby facilitating better comfort and fit of article 100 on a foot.

Figure 6:
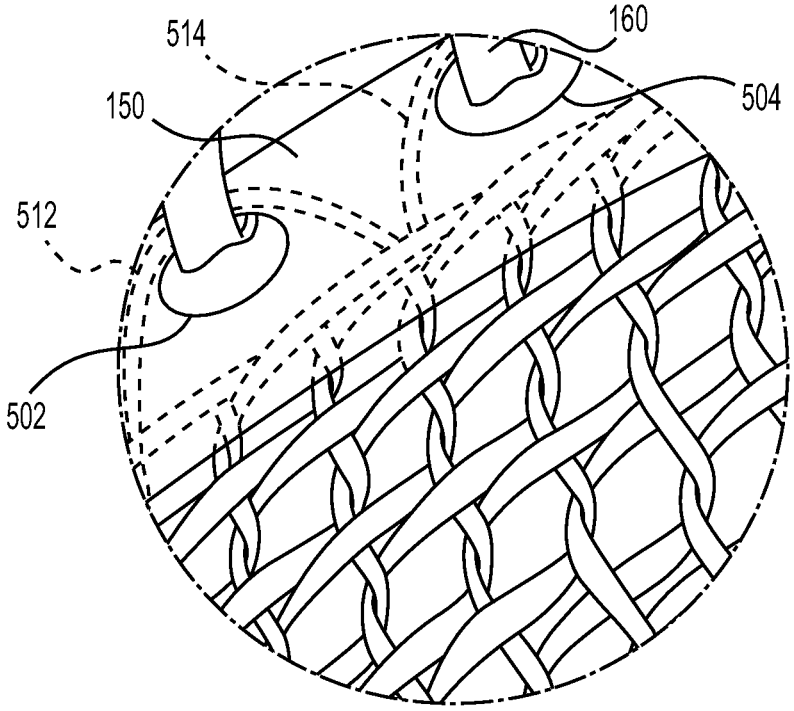
FIG. 6 is a schematic enlarged view of an embodiment of an overlay including eyelets, in which each eyelet is partially encircled by a strand of a braided upper.
Figure 7:
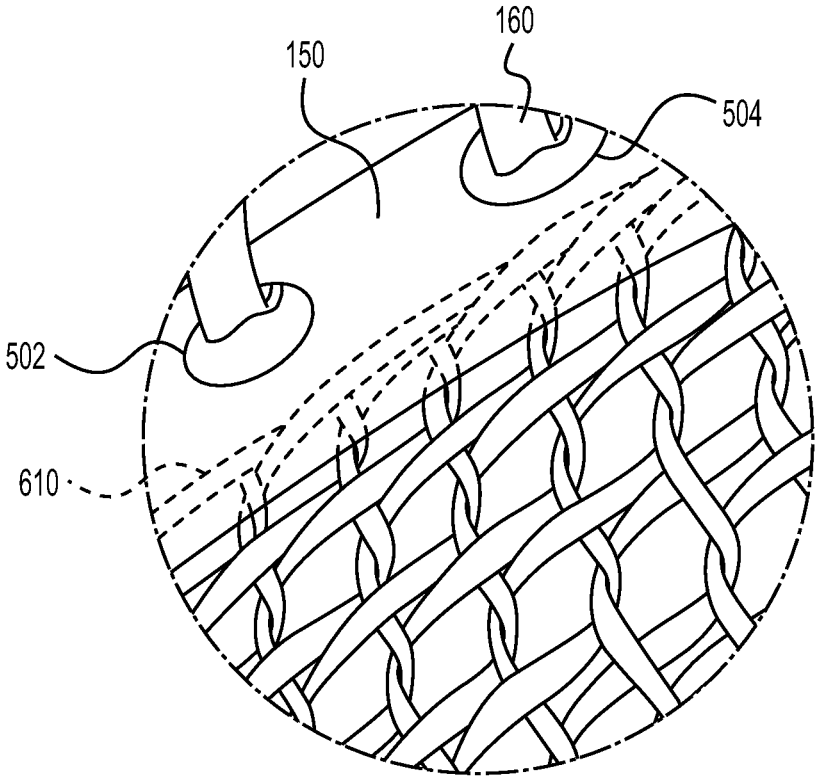
FIG. 7 is a schematic enlarged view of another embodiment of an overlay including eyelets, in which strands of a braided upper do not encircle each eyelet.

FIGS. 6 and 7 illustrate two possible configurations for strands in the vicinity of eyelets on an overlay portion. Referring first to FIG. 6, in some embodiments, one or more strands may extend around an eyelet, thereby acting to reinforce the eyelet. For example, in FIG. 6, first strand 512 and second strand 514 wrap around first eyelet 502 and second eyelet 504, respectively. This may have the effect of reinforcing first eyelet 502 and second eyelet 504, as well as providing a more direct transfer of tension between fastening member 160 and the braided strands of upper 102.

Referring to an alternative embodiment shown in FIG. 7, first eyelet 502 and second eyelet 504 are not surrounded by any strands of the upper. In particular, it may be seen that strands 610 are bonded to first overlay portion 150 without encircling first eyelet 502 and second eyelet 504. Of course, in still other embodiments, some eyelets may be surrounded or reinforced by strands while other eyelets may not be surrounded or reinforced.

Figure 8:
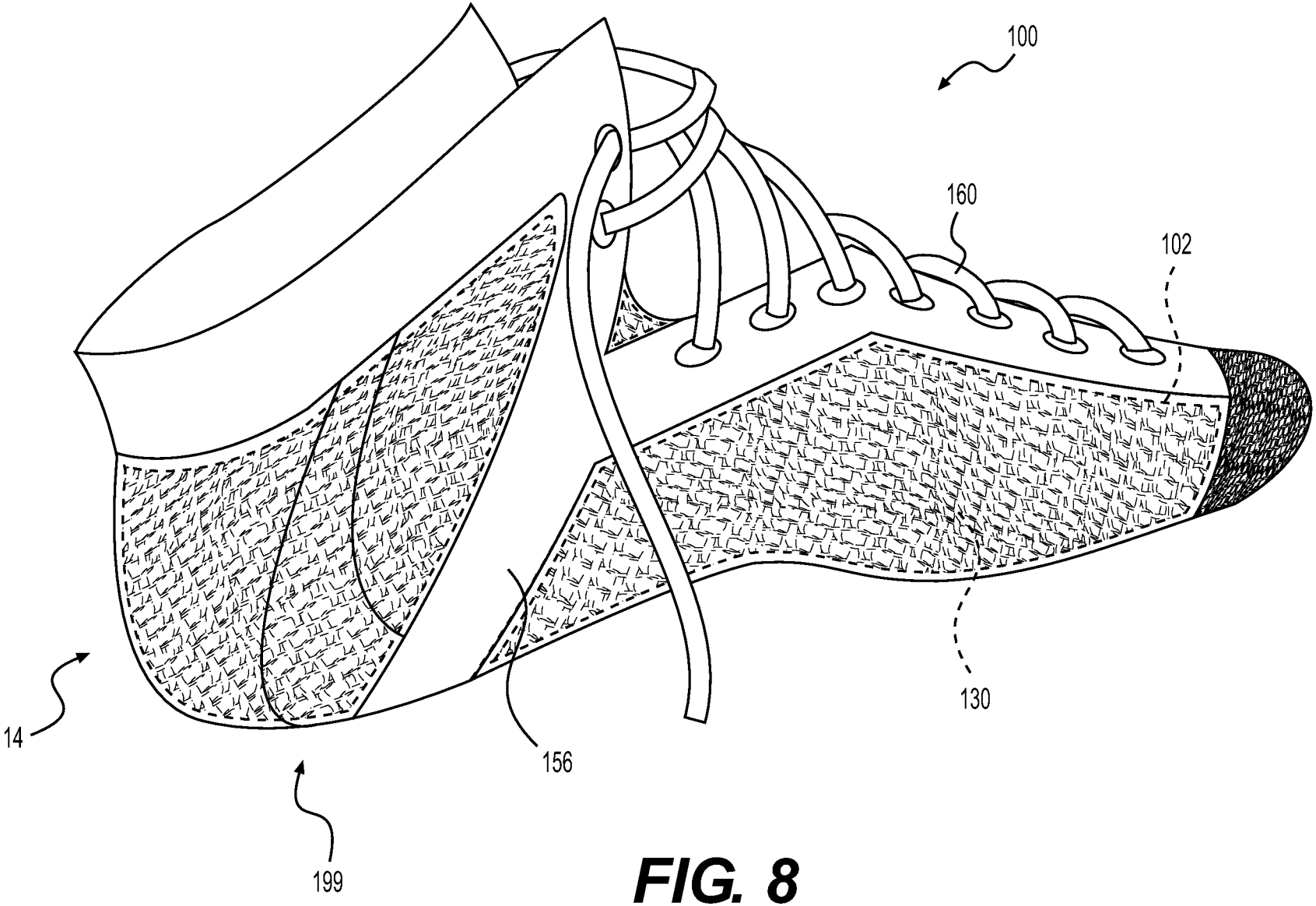
FIG. 8 is a schematic rear isometric view of an embodiment of an article of footwear including a braided upper with overlays.

FIG. 8 illustrates a rear isometric view of upper 102, in which strands 130 of upper 102 are shown in phantom. Referring to FIG. 7, third overlay component 156 is seen to wrap underneath a bottom side 199 of upper 102 at heel portion 14. In some cases, this configuration allows third overlay portion 156 to cradle the heel of the foot. Thus, this arrangement may provide further support for the heel of the foot when article 100 is worn by reducing stretching through heel portion 14.

In some embodiments, multiple distinct overlay components may be used. In some embodiments, distinct overlay components may be configured to intersect or overlap at predetermined portions of an upper. Such configurations of overlapping overlay components may provide a means for enhancing strength and stretch resistance over large portions of an upper, including, possibly, the entirety of the upper.

Figure 9:
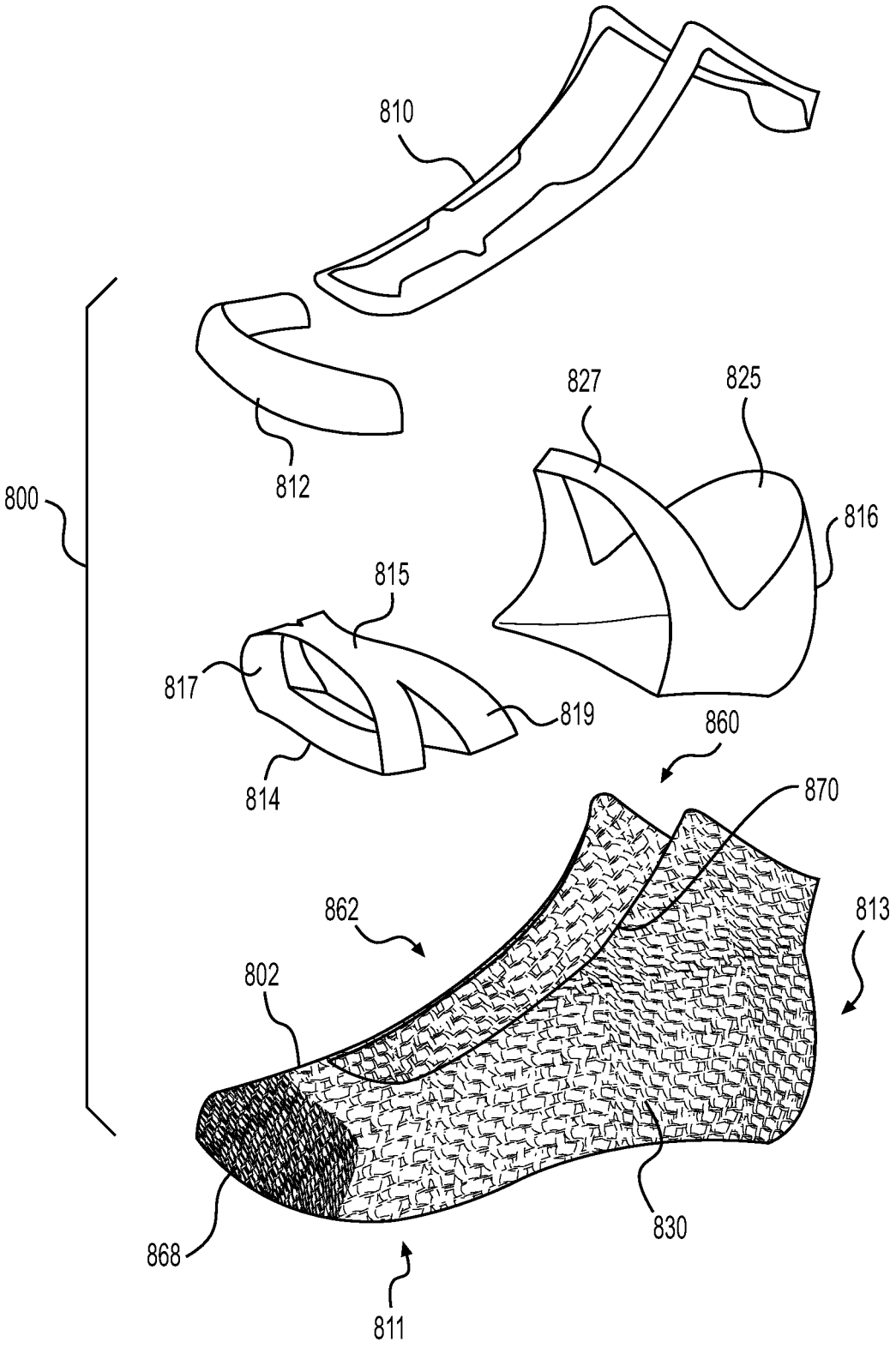
FIG. 9 is a schematic exploded isometric view of an embodiment of an article of footwear including a braided upper with multiple distinct overlays.
Figure 10:
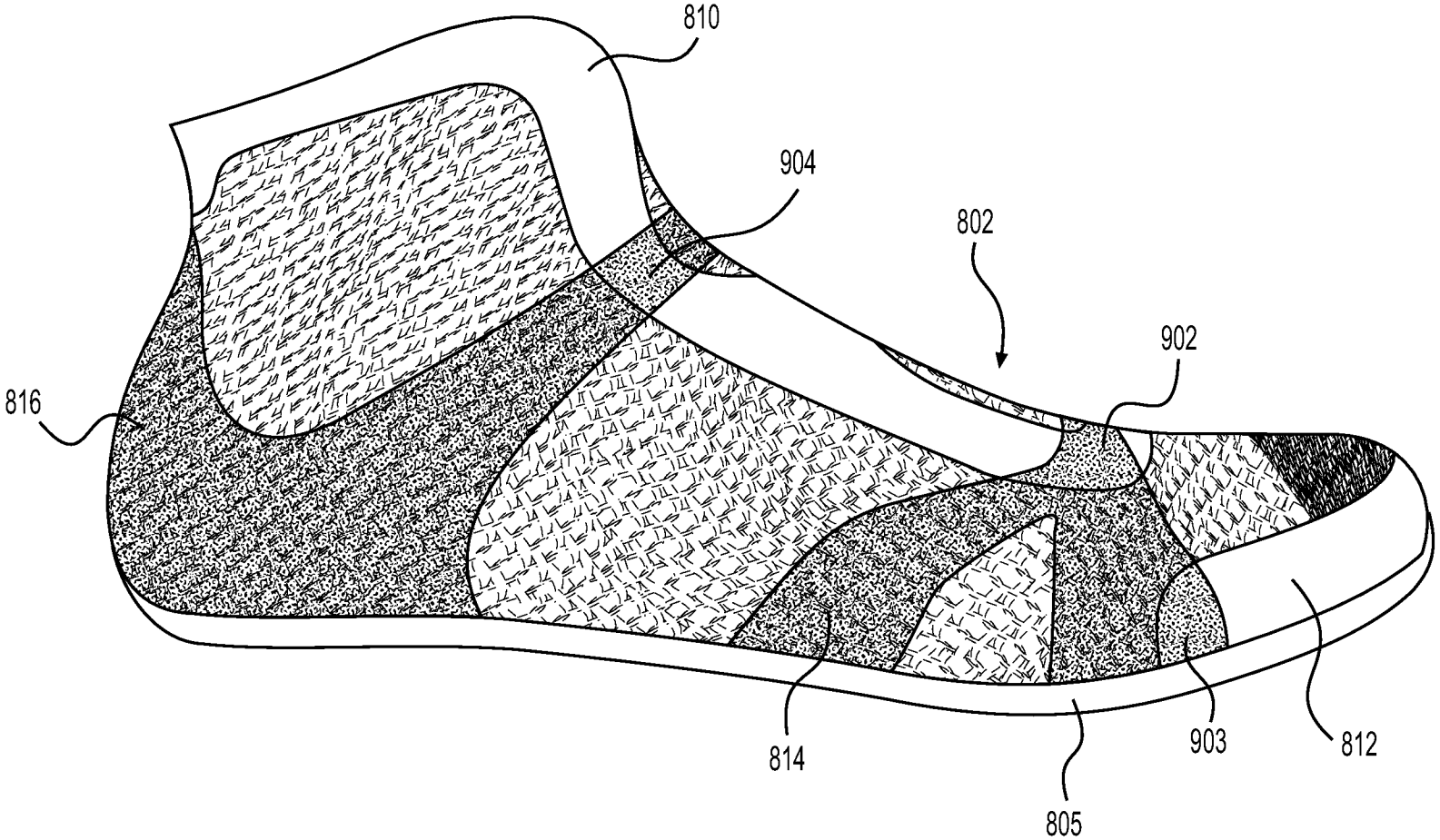
FIG. 10 is a schematic side view of the article of footwear of FIG. 9.
Figure 11:
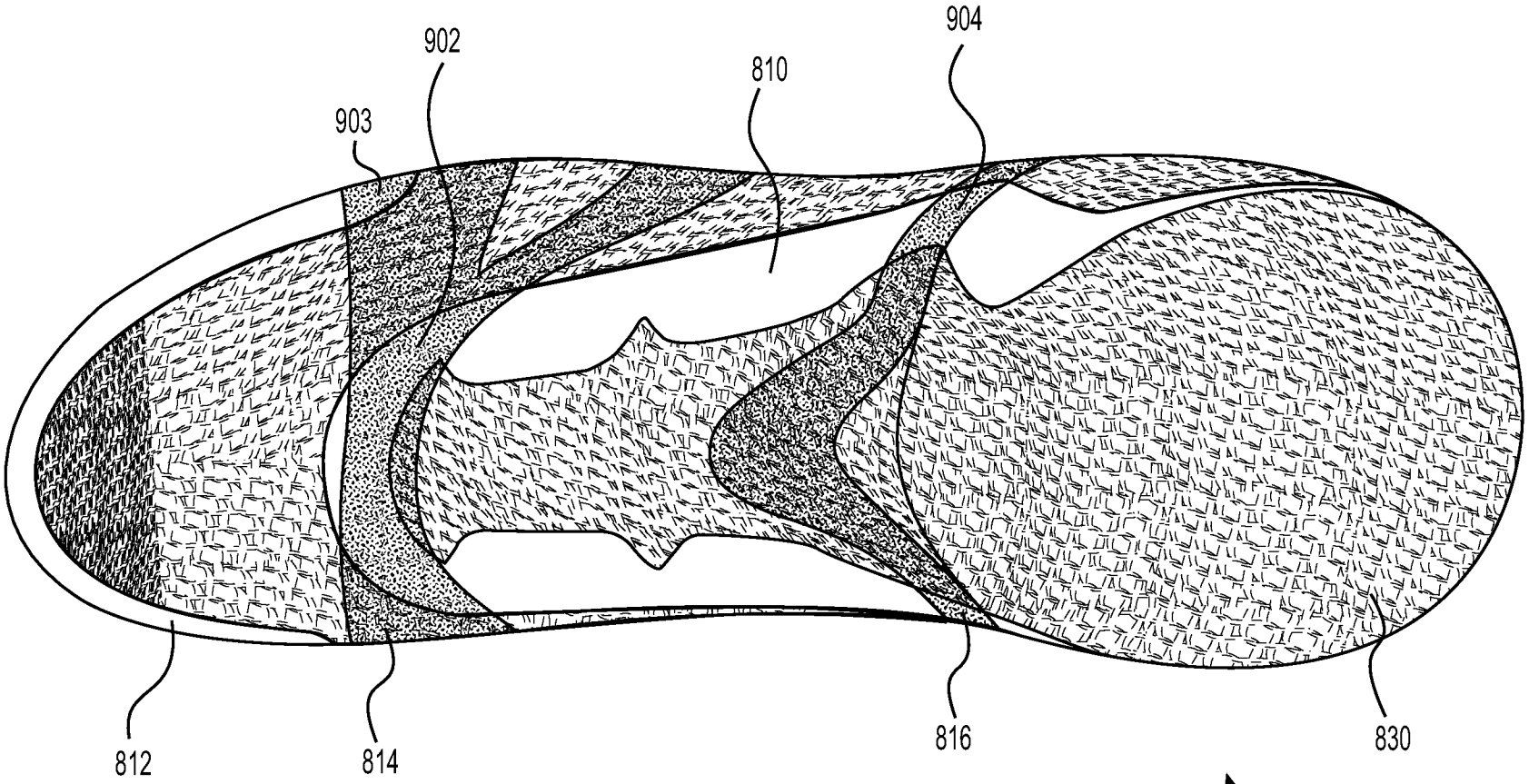
FIG. 11 is a schematic top view of the article of footwear of FIG. 9.

FIGS. 9-11 illustrate an embodiment of an article of footwear 800, comprising an upper 802 and a sole structure 805 (shown in FIG. 10 only). Referring first to FIG. 9, upper 802 is comprised of a braided structure that is braided from a plurality of strands 830. In addition, multiple overlay components are associated with upper 802, including a first overlay component 810, a second overlay component 812, a third overlay component 814 and a fourth overlay component 816.

In the exemplary embodiment, each overlay component is associated with a particular portion of upper 802. For example, first overlay component 810 is associated with the edges 870 of opening 860 and fastening region 862. Thus, in some cases, first overlay component 810 may be used to finish plurality of strands 830 along edges 870. Additionally, first overlay component 810 may provide stretch resistance in the vicinity of opening 860.

Second overlay component 812 is associated with forward toe portion 868 of upper 802. In some embodiments, second overlay component 812 may help improve stretch resistance at forward toe portion 868. Additionally, in some embodiments, second overlay component 812 may provide a covering for forward toe portion 868. In particular, the presence of second overlay component 812 may help prevent debris from entering upper 802 through forward toe portion 868.

Third overlay component 814 may be associated with a forefoot portion 811 of upper 802. In some embodiments, third overlay component 814 may be positioned forwards of fastening region 862. Furthermore, as clearly seen in FIG. 9, third overlay component 814 may completely encircle upper 802 (and a foot within upper 802). In an exemplary embodiment, third overlay component 814 is comprised of a first band 817 and a second band 819, which are integrally joined at top intersection region 815. This arrangement may therefore provide targeted stretch resistance at forefoot portion 811 that enhances support of the foot during activities where forefoot portion 811 may be firmly planted on the ground.

Fourth overlay component 816 may be associated with heel portion 813 of upper 802. In some embodiments, fourth overlay component 816 may provide a heel-counter like overlay portion 825, as well as a strap-like overlay portion 827. In combination, overlay portion 825 and overlay portion 827 may help limit stretching at heel portion 813 and may therefore enhance support of the heel within upper 802.

As seen in FIGS. 10-11, when assembled with upper 802, some of the overlay components may overlap with one another. For example, third overlay component 814 is clearly seen to overlap with portions of first overlay component 810 at an overlap region 902. In addition, third overlay component 814 is seen to overlap with portions of second overlay component 812 at an overlap region 903. Likewise, fourth overlay component 816 is clearly seen to overlap with portions of first overlay component 810 at an overlap region 904. This overlapping arrangement may help enhance the structural integrity of upper 802, since portions of one overlay component may reinforce the support of an overlapping overlay component. Moreover, by overlapping and joining portions of different overlay components together, the overlay components may function as a unitary frame for supporting the braided structure of upper 802.

Embodiments utilizing braided regions having different properties may include provisions for further reinforcing some regions but not others. In some embodiments, an article may include an overlay portion that is configured to cover a predetermined region of the article.

Figure 12:
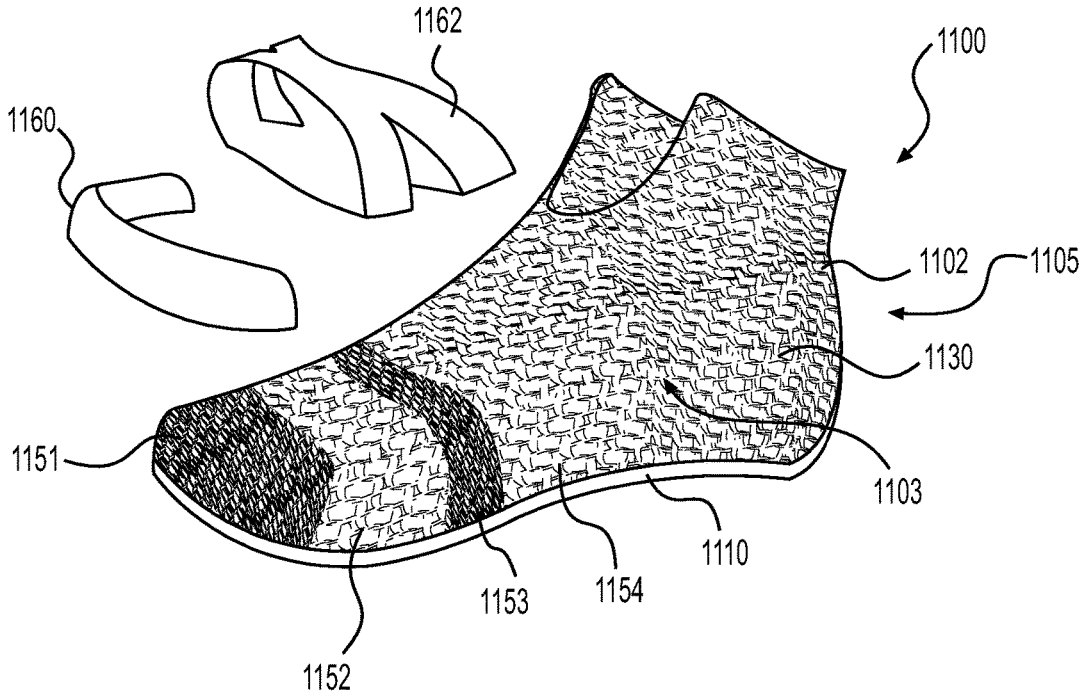
FIG. 12 is a schematic isometric view of an embodiment of an article of footwear with two different braided regions and overlays covering the braided regions.
Figure 13:
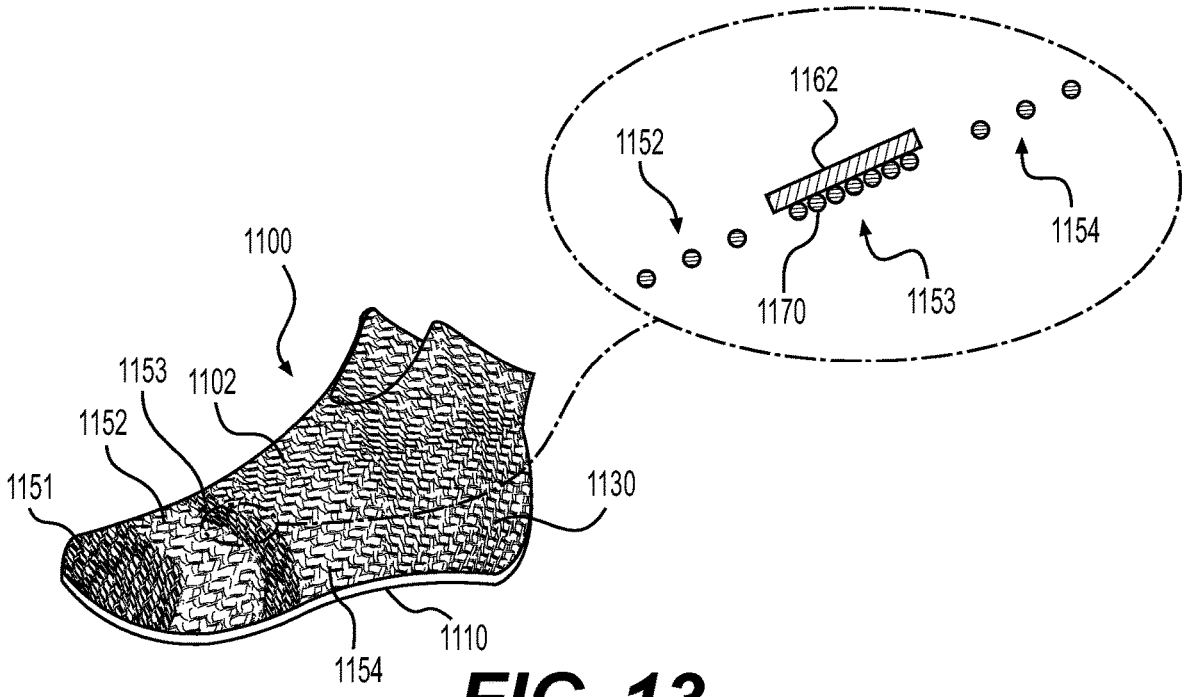
FIG. 13 is a schematic isometric view of the article of footwear of FIG. 12, in which a portion of the braided upper and an overlay are seen in cross-section.

FIGS. 12 and 13 illustrate isometric views of an article 1100 that is configured with overlay portions that cover two specific regions of an upper 1102. Specifically, FIG. 12 illustrates an isometric exploded view of article 1100, while FIG. 13 illustrates an isometric view including an enlarged cross-sectional view. Referring to FIGS. 12 and 13, article 1100 includes upper 1102 and sole system 1110. Upper 1102 is further configured with at least four distinct regions, including a first region 1151, a second region 1152, a third region 1153 and a fourth region 1154. In the exemplary embodiment, first region 1151 is a toe region of upper 1102. Second region 1152 is disposed directly adjacent to, and rearwards of, first region 1151. Third region 1153 is disposed adjacent to, and rearwards of, second region 1152. Finally, fourth region 1154 extends rearwards of third region 1153. Moreover, fourth region 1154 is a substantially larger region than the remaining regions, and includes the entirety of midfoot portion 1103 and heel portion 1105 of upper 1102. Thus, first region 1151, second region 1152 and third region 1153 may be characterized as bands of upper 1102 that extend laterally across upper 1102.

Each region of upper 1102 may be associated with a particular material characteristic, such as a braiding density. In the exemplary embodiment, first region 1151 and third region 1153 are both associated with a first braiding density, while second region 1152 and fourth region 1154 are associated with a second braiding density. In some embodiments, the first braiding density may be greater than the second braiding density. Thus, first region 1151 and third region 1153 are more tightly braided and may provide regions of increased strength and may also resist stretching in some embodiments.

Article 1100 may be further associated with first overlay portion 1160 and second overlay portion 1162. First overlay portion 1160 may be shaped to cover first region 1151 of upper 1102. Second overlay portion 1162 may be shaped to cover third region 1153 of upper 1102. For example, as shown in the enlarged cross-sectional view of FIG. 13, second overlay portion 1162 may be disposed over strands 1170 of third region 1153. With this arrangement, first overlay portion 1160 and second overlay portion 1162 may further reinforce first region 1151 and second region 1152, thereby enhancing support and stretch resistance in these regions.

The exemplary embodiments are only intended to illustrate some possible configurations for overlay portions on an upper. It should be understood that some other embodiments may include overlay portions configured in a variety of different shapes, sizes and locations. Moreover, any number of distinct overlay components can be used in alternative embodiments. The number, shape, size and location of overlay components or overlay portions can be selected to achieve desired properties including stretch resistance, enhanced strength, support, comfort or any other desired properties at any locations on an article of footwear.

As discussed in the Braided Upper application, braided uppers can be configured with a variety of different features and functionality. It should be understood that the overlay portions described in this detailed description may be utilized with a variety of different embodiments of braided uppers, which may or may not include some of the features discussed in the Braided Upper application. As an example, in some embodiments, strands with different material properties could be braided together, or otherwise associated with one another, to provide specific properties at one or more regions of an upper. For example, an upper may be fabricated from fibers that stretch to a certain degree, as the wearer's foot moves through each stride he or she takes, thus increasing the wearer's comfort. In that case, high tensile strength, non-stretch fibers may be threaded through those specific regions of the footwear that require additional structural support. As another example, an upper may be fabricated with a more open braid in some areas, for example to improve breathability or comfort. In that case, additional fibers may be laced through the braid to provide additional support in certain parts of those areas, or to provide increased durability for high-impact regions of the footwear. An upper having any of these configurations may be further associated with one or more overlay portions in order to further control the characteristics and functionality of the upper, including support and/or stretch resistance in various areas of the upper.

The upper may also have floating cables, i.e., cables that are not braided into the fabric of the upper may be used to relieve the stress on certain sections of the upper. The floating cables may be made of a different material that is separate from and not attached to the braided structure. The cables may also be used as laces to secure the footwear to the foot, or to tighten up certain parts of the footwear, as described below. For example, the cables may be anchored at a first end at the sole of the footwear, and at a second end at an eyelet, for example. Such floating cables may also be used to add to the support and stability of certain parts of the footwear, such as around the ankle opening. In some embodiments, overlay portions may be used with braided uppers incorporating floating cables, and in some cases the overlay portions may be used to reinforce portions with cables or portions without cables. In some embodiments, overlay portions could be used to help anchor ends of the floating cables to the upper.

The combination of these features, including any of the features described in the Braided Upper application, in conjunction with the overlay portions described above and shown in the figures may facilitate the creation of uppers tailored to a particular athletic or recreational activity. Braided uppers with combinations of these features can be very light while conforming closely and comfortably to the wearer's feet. In some embodiments, the fit of the upper may be adjusted to provide the specific degree of tension or tightness the wearer may prefer.

Figure 14:
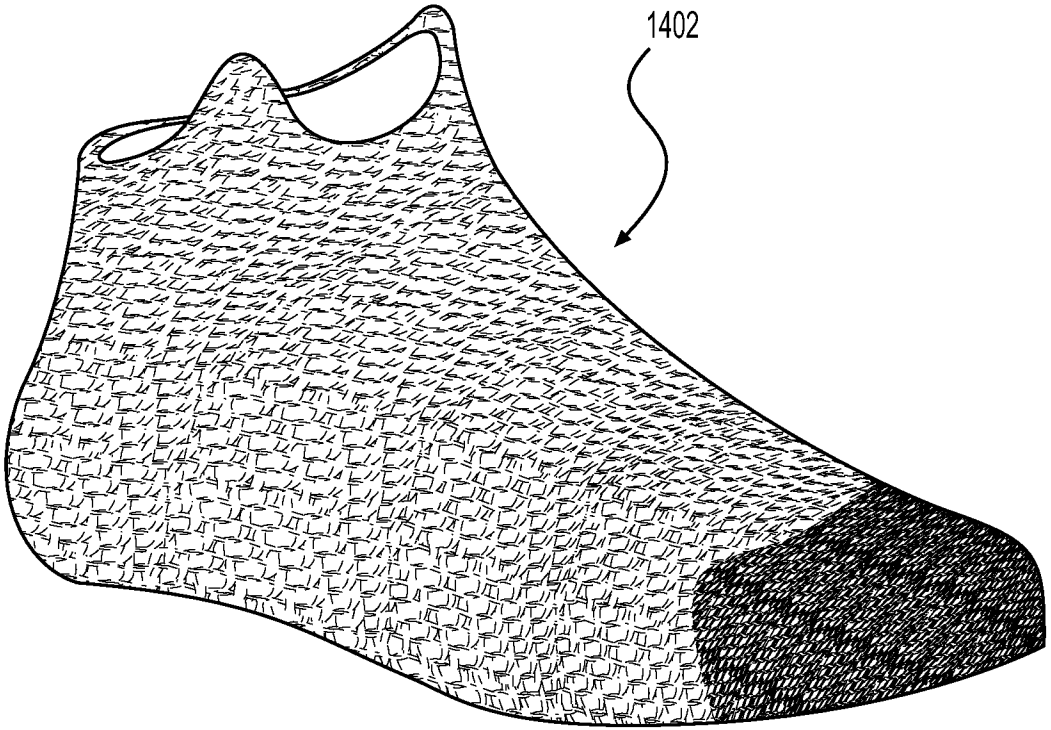
FIG. 14 is a side schematic view of an embodiment of a pre-cut braided structure shaped as an upper for an article of footwear.
Figure 15:
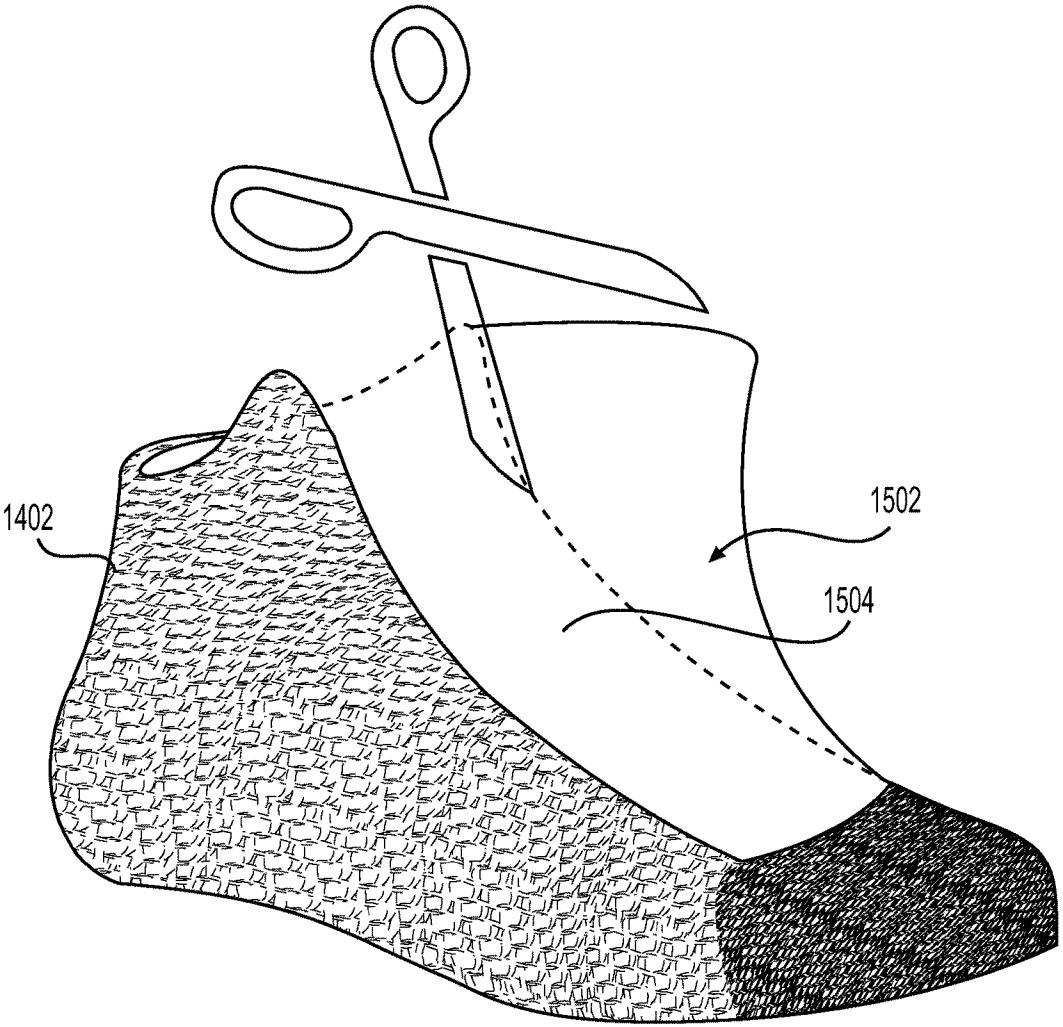
FIG. 15 is a schematic view of a step of cutting the braided structure of FIG. 14 in order to form an opening in the upper, according to an exemplary process.
Figure 16:
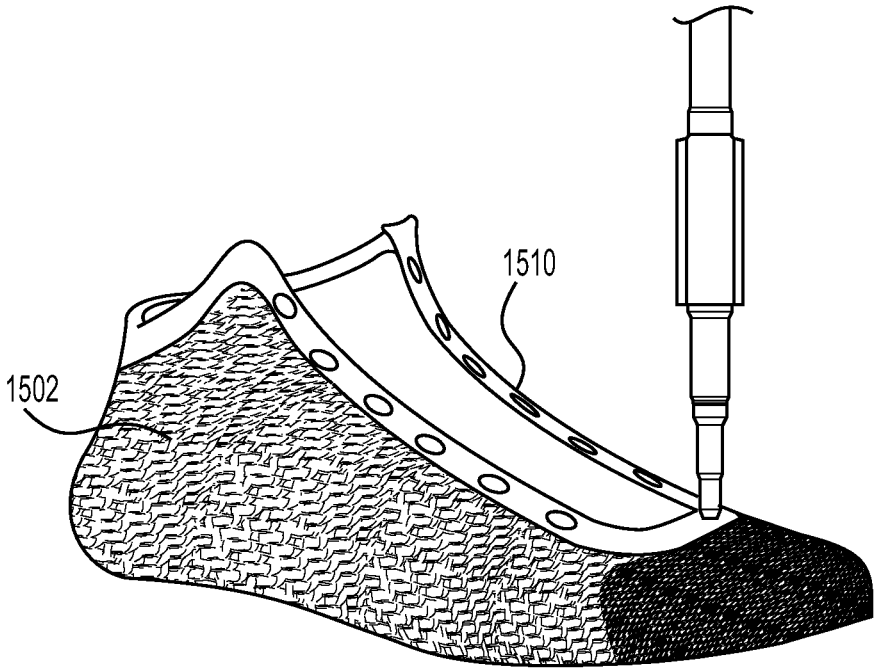
FIG. 16 is an isometric view of a step of joining an overlay to the upper of FIG. 15, according to an exemplary process.

FIGS. 14-17 illustrate several steps in an exemplary process of forming an article comprised of a braided upper and overlay portions. Initially, as shown in FIG. 14, a braided upper 1402 may be formed using any kind of braiding process. An exemplary process for forming braided articles is disclosed in the Braided Upper application, which has been previously discussed and incorporated by reference. Next, as shown in FIG. 15, in some embodiments, an opening 1502 may be cut into upper 1402. This may create a new edge 1504 that bounds opening 1502. Opening 1502 may be used for insertion of a foot, and may provide a region for a fastener, such as a lace.

Figure 17:
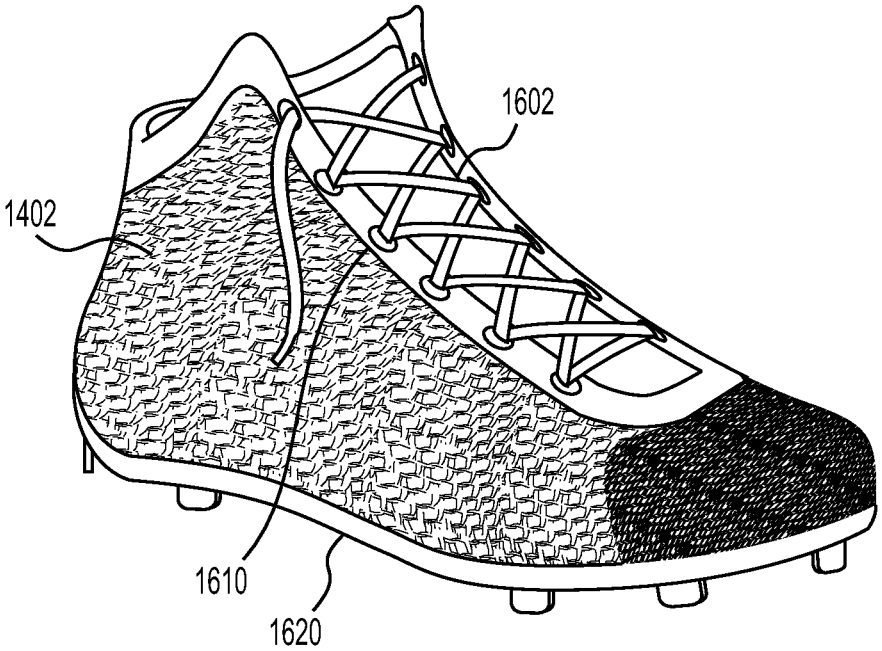
FIG. 17 is an isometric view of an embodiment of a finished article of footwear constructed using the exemplary process of FIGS. 14-16.

In an exemplary embodiment, an overlay portion 1510 may then be bonded along edge 1504 (see FIG. 15) of upper 1402, as shown in FIG. 17. In some embodiments, the bonding may be achieved using a welding process, such as an ultrasonic welding process. The strands exposed along edge 1504 may thereby be fused to overlay portion 1510 to finish the ends as well as to reinforce and support edge 1504 when the article is fastened. Finally, as shown in FIG. 17, a lace 1602 may be inserted through eyelets 1610. Additionally, in some embodiments, a sole system 1620 may be added to the bottom of upper 1402.

Some embodiments can include provisions to facilitate the joining of an upper and a sole system. In some embodiments, an overlay portion may be provided between an upper and a sole system, thereby facilitating the joining of the upper and the sole system.

Figure 18:
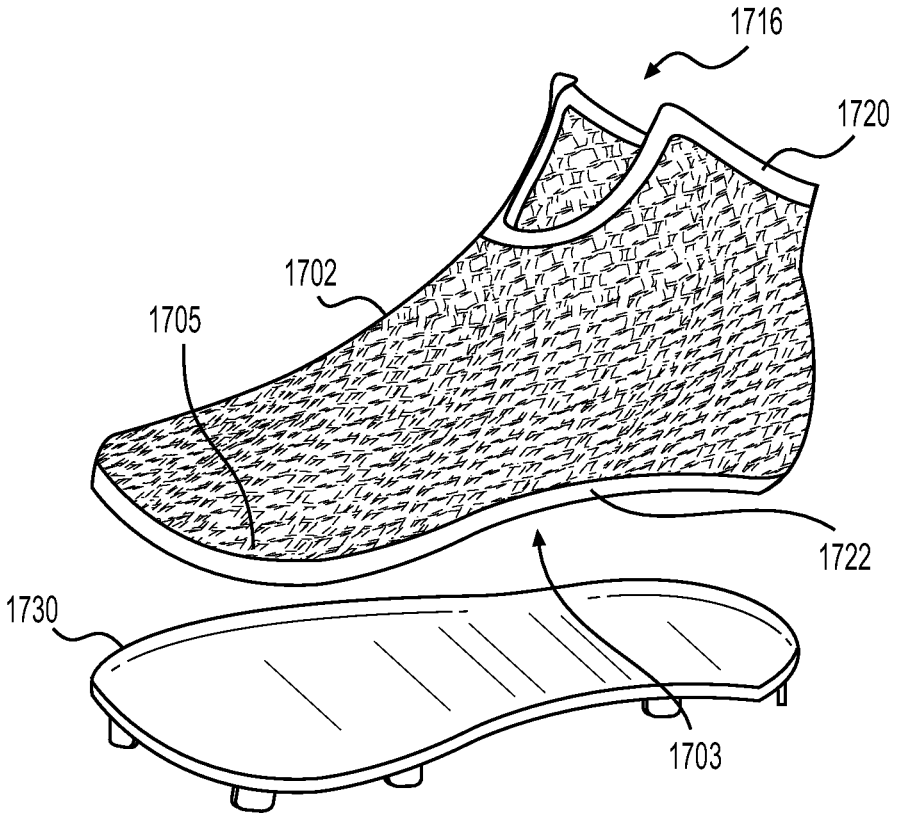
FIG. 18 is an isometric view of an embodiment of a braided upper with an overlay on a lower surface being associated with a sole member.
Figure 19:
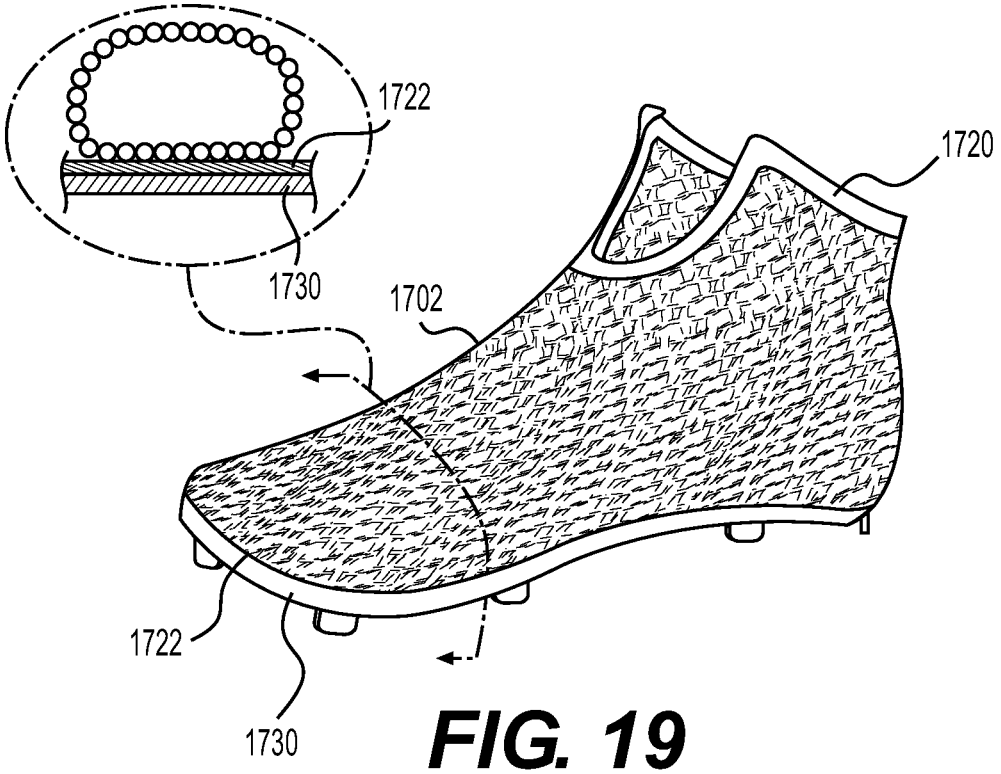
FIG. 19 is an isometric view of the braided upper of FIG. 18 joined with the sole member.

FIGS. 18 and 19 illustrate isometric views of an embodiment in which an overlay portion may be used to help attach a sole system to an upper. Referring to FIGS. 18 and 19, an upper 1702 may be associated with an overlay component 1720 and an overlay component 1722. In some embodiments, overlay component 1720 may be associated with an opening 1716 of upper 1702. Overlay component 1722 may be associated with a lower side 1703 of upper 1702. In some embodiments, overlay component 1722 may extend over the entirety lower side 1703, though in other embodiments, overlay component 1722 may only extend over some portions of lower side 1703. Moreover, in some cases, overlay component 1722 may partially extend up around a lower periphery 1705 of upper 1702.

In some embodiments, a sole system 1730 may be associated with upper 1702. In some embodiments, moreover, overlay component 1722 may facilitate the bonding or joining of sole system 1730 to upper 1702. For example, as clearly seen in the enlarged cross-sectional view in FIG. 19, overlay component 1722 may be disposed between sole system 1730 and lower side 1703 of upper 1702 to facilitate the joining sole system 1730 with upper 1702.

In some embodiments, the material properties of overlay component 1722 and sole system 1730 can be selected so that overlay component 1722 and sole system 1730 may be easily bonded using an adhesive or other process. For example, it is contemplated that in some embodiments, overlay component 1722 may be made of a thermoplastic urethane (TPU) material, and sole system 1730 may be made of a similar material or a material that easily bonds with TPU. In still other embodiments, however, overlay component 1722 and sole system 1730 can be made of any other materials that can be joined with or without a separate adhesive.

Figure 20:
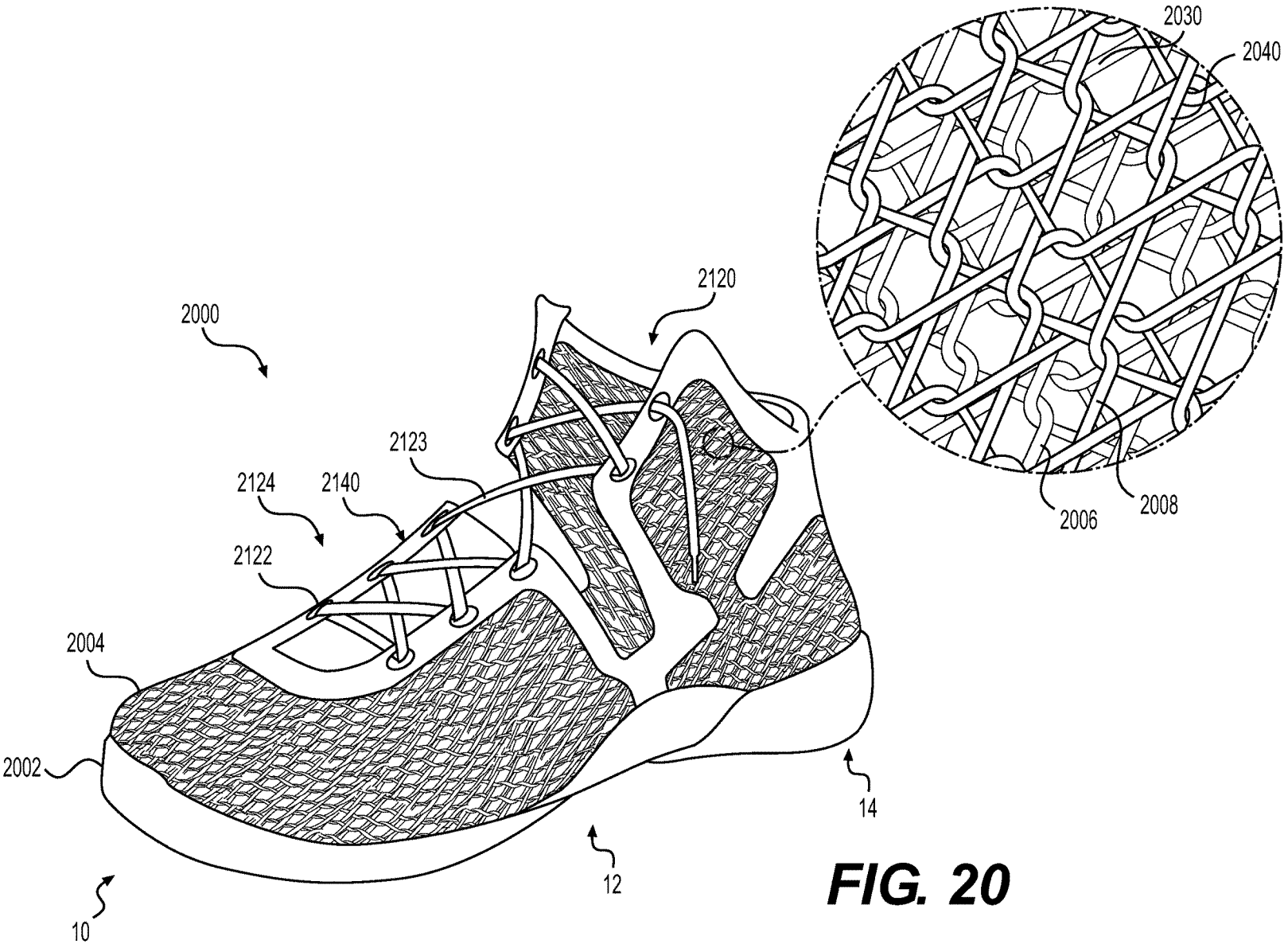
FIG. 20 is an isometric view of an exemplary embodiment of an article of footwear with a first braided structure, a second braided structure, and an overlay.

FIGS. 20-24 illustrate an embodiment of an article of footwear 2000, or simply article 2000. In some embodiments, the article may comprise an upper having multiple braided structures. Referring first to FIG. 20, the article 2000 includes a sole system 2002 and an upper 2004. The sole system 2002 may be similar to sole system 110 of FIG. 1. The upper 2004 includes a first braided structure 2006 and a second braided structure 2008. Moreover, for purposes of reference, components of article 2000, such as upper 2004, may be divided into forefoot portion 10, midfoot portion 12, and heel portion 14.

Similarly to the upper 102 of FIG. 1, upper 2004 may have any design, shape, size and/or color. For example, in embodiments where article 2000 is a basketball shoe, upper 2004 could be a high top upper that is shaped to provide high support on an ankle. In embodiments where article 2000 is a running shoe, upper 2004 could be a low top upper.

In some embodiments, the first braided structure 2006 and the second braided structure 2008 may be formed by intertwining three or more strands of yarn, filaments, or other fibers to form the structure. For example, the first braided structure 2006 is formed from a plurality of strands (e.g., strand 2030) that are braided together to form a shape that is globally similar to the shape of a foot. Similar, the second braided structure 2008 may be formed from a plurality of strands (e.g., strand 2040) that are braided together to form a shape that is globally similar to the shape of a foot. The strand 2030 and/or the strand 2040 may be formed of similar materials and methods as the strands 130 (see FIG. 1).

In some embodiments, the first braided structure 2006 and the second braided structure 2008 have similar structures. For example, the first braided structure 2006 and the second braided structure 2008 may both utilize a specific weaving pattern. In some embodiments, the first braided structure 2006 and the second braided structure 2008 may both have a particular density of weave. In one embodiment, the first braided structure 2006 and the second braided structure 2008 may both be formed using a particular structure of weave.

In certain embodiments, the strand 2030 and the strand 2040 have similar structures. In some embodiments, the strand 2030 and the strand 2040 have a common thickness. In one embodiment, the strand 2030 and the strand 2040 are made of a common material. For example, the strand 2030 and the strand 2040 may comprise a filament impregnated with a thermoplastic.

In other embodiments, the first braided structure 2006 and the second braided structure 2008 may differ. Such differences may include, for example, a weave technique, a structure, a density of weave, a type of filament, a processing of the filament, and the like. For example, the first braided structure 2006 may be formed of a weave and structure having a soft feel, a low density, and a soft yarn further processed to be hydrophobic. In the example, the second braided structure 2008 may be formed of a weave and structure for maximizing durability, a high density, and a carbon fiber further processed to be reinforced with a resin.

Various characteristics within a braided structure (e.g., first braided structure 2006, second braided structure 2008, etc.) may be consistent within the structure or may vary. For instance, the forefoot portion 10 of the first braided structure 2006 may utilize a more durable weave technique than a weave technique utilized in the heel portion 14 of the first braided structure 2006. Similarly, the forefoot portion 10 of the first braided structure 2006 may utilize a more rugged structure than a structure utilized in the heel portion 14 of the first braided structure 2006. Further, the forefoot portion 10 of the first braided structure 2006 may utilize a higher density weave than a weave utilized in the heel portion 14 of the first braided structure 2006. Moreover, the forefoot portion 10 of the first braided structure 2006 may utilize a tougher filament than a filament utilized in the heel portion 14 of the first braided structure 2006. Such filaments may be made tougher, for instance, by impregnating the filaments with a resin. Although the above examples were with respect to the first braided structure 2006, the examples may also apply to the second braided structure 2008.

In some embodiments, the braided structures may have coordinated characteristics. For instance, the first braided structure 2006 and the second braided structure 2008 may both use a denser weave in a heel portion 14 than in midfoot portion 12. In another embodiment, one of the braided structures has changes in characteristics that do not correspond to the other braided structure. For example, the first braided structure 2006 uses a particular weave technique throughout, while the second braided structure 2008 includes a heel portion 14 and a forefoot portion 10 having different characteristics.

In one aspect, the braided structures are formed (e.g., braided) separately and subsequently combined, or may be formed simultaneously. For instance, a first shoe last may be inserted into a braiding machine to create the first braided structure 2006 and a second shoe last may be inserted into the braiding machine or another braiding machine to create the second braided structure 2008. Alternatively, a single shoe last may be inserted once into a braiding machine to create the first braided structure 2006 and the second braided structure 2008.

In various instances, the first braided structure 2006 and the second braided structure 2008 are held by an overlay system 2140. The overlay system 2140 may be made similarly to overlay component 140. For instance, the overlay system 2140 may be formed of a thermoplastic, and include eyelets 2122 for fastening member 2123 (e.g., fastening member 160).

In some embodiments, the stretch resistance of overlay system 2140 may differ from one or more braided structures. For example, in some embodiments, overlay system 2140 may be more stretch resistant (e.g., stretch less) than first braided structure 2006 and/or second braided structure 2008. In other embodiments, however, overlay system 2140 may have a similar stretch resistance to first braided structure 2006 and/or second braided structure 2008.

Figure 21:
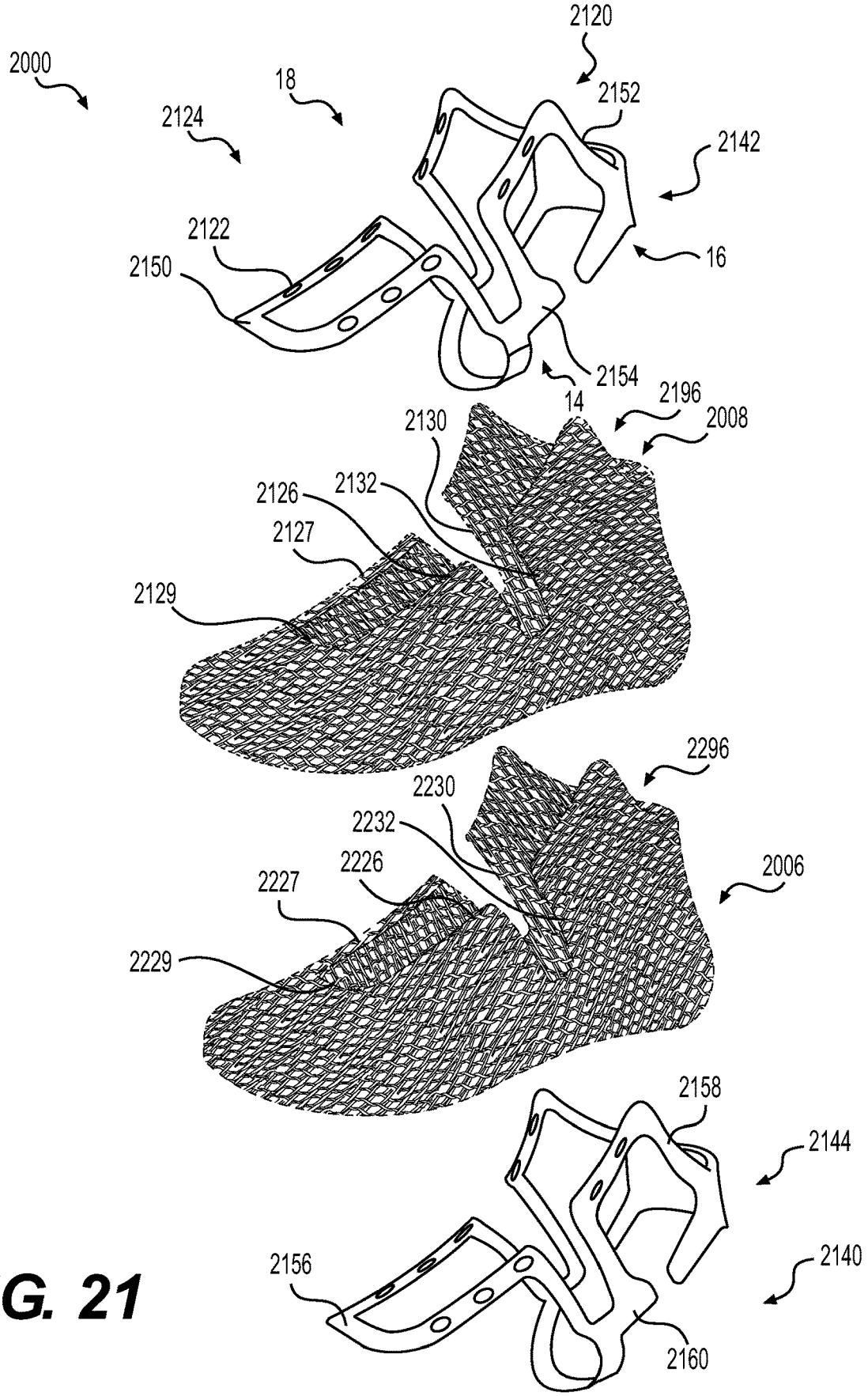
FIG. 21 is an exploded view of the article of footwear of FIG. 20, in accordance with an exemplary embodiment.

In certain embodiments, the overlay system includes a first layer to prevent the first braided structure from being overly stretched. For example, as shown in FIG. 21, the overlay system 2140 includes a first layer 2144 formed on the first braided structure 2006. Similarly, in some embodiments, the overlay system includes a second layer to prevent the second braided structure from being overly stretched. For example, as shown in FIG. 21, the overlay system 2140 includes a second layer 2142 formed on the second braided structure 2008.

In varying embodiments, the second layer includes a first overlay portion to support a heel region of a foot. For example, the second layer 2142 includes a first overlay portion 2154 associated with the heel portion 14. In one embodiment, the first overlay portion 2154 may limit a stretch of the second braided structure 2008 in order to support a foot inserted into the article 2000. In some embodiments, the first overlay portion extends into the lateral side and the medial side of the upper. For example, as illustrated, the first overlay portion 2154 extends into the lateral side 16 and the medial side 18. In other embodiments, the first overlay portion extends into either the lateral side or the medial side. For example, the first overlay portion 2154 extends into the lateral side 16 and is separated from the medial side 18 (not shown). In another example, the first overlay portion 2154 extends into the medial side 18 and is separated from the lateral side 16 (not shown).

In some embodiments, the second layer includes a second overlay portion to support the article during an insertion of a foot. For example, the second layer 2142 includes a second overlay portion 2152 associated with the opening 2120. In one embodiment, the second overlay portion 2152 may limit a stretch of the second braided structure 2008 in order to allow an insertion of a foot into the article 2000 without overly stretching the second braided structure 2008.

In one embodiment, the second layer includes a third overlay portion to support the fastening region to allow for a fastening of the article to a foot. For example, the second layer 2142 includes a third overlay portion 2150 associated with fastening region 2124. As shown, in one embodiment, the third overlay portion 2150 may include eyelets 2122 for receiving the fastening member 2123. Moreover, in some embodiments, the third overlay portion 2150 may limit a stretch of the second braided structure 2008 in order to allow a tugging of the fastening member 2123 without overly stretching the second braided structure 2008.

In some embodiments, the overlay portions are substantially continuous to cover the various edges of the upper 2004. For example, as shown in FIG. 21, the first overlay portion 2154, the second overlay portion 2152, and the third overlay portion 2150 are substantially continuous. In other embodiments, the third overlay portion 2150 is substantially continuous with the second overlay portion 2152 and the third overlay portion 2150 is separated from the first overlay portion 2154. In one embodiment, the third overlay portion 2150 is substantially continuous with the first overlay portion 2154 and the third overlay portion 2150 is separated from the second overlay portion 2152. In some embodiments, the second overlay portion 2152 is substantially continuous with the first overlay portion 2154 and the second overlay portion 2152 is separated from the third overlay portion 2150.

As noted above, in various embodiments, the overlay system includes a first layer to prevent the first braided structure from being overly stretched. For example, as shown in FIG. 21, the overlay system 2140 includes a first layer 2144 formed on the first braided structure 2006. In some embodiments, the first layer 2144 is similar to the second layer 2142. For example, the first layer 2144 may include a sixth overlay portion 2156 associated with fastening region 2124. In another example, the first layer 2144 includes a fifth overlay portion 2158 associated with the opening 2120. In yet another example, the first layer 2144 includes a fourth overlay portion 2160 associated with the heel portion 14. In other embodiments, the first layer 2144 and the second layer 2142 are different.

In one embodiment, the overlay system extends along an opening edge to support the first braided structure and/or the second braided structure. For example, as shown in FIG. 21, the fifth overlay portion 2158 may extend on first opening edge 2296. This arrangement helps to finish the first opening edge 2296 of the first braided structure 2006 by bonding any open strands to the fifth overlay portion 2158. In another example, the second overlay portion 2152 extends on a second opening edge 2196. Similar to the above, this arrangement helps to finish the second opening edge 2196 of the second braided structure 2008 by bonding any open strands to the second overlay portion 2152.

In some embodiments, the overlay system extends along a lateral midfoot edge to support the first braided structure and/or the second braided structure. For example, as shown in FIG. 21, the fifth overlay portion 2158 may extend on the first lateral midfoot edge 2232. This arrangement helps to finish the first lateral midfoot edge 2232 by bonding any open strands to the fifth overlay portion 2158. In another example, the second overlay portion 2152 extends on the second lateral midfoot edge 2132. Similar to the above, this arrangement helps to finish the second lateral midfoot edge 2132 of the second braided structure 2008 by bonding any open strands to the second overlay portion 2152.

In varying embodiments, the overlay system extends along a medial midfoot edge to support the first braided structure and/or the second braided structure. For example, as shown in FIG. 21, the fifth overlay portion 2158 may extend on the first medial midfoot edge 2230. This arrangement helps to finish the first medial midfoot edge 2230 by bonding any open strands to the fifth overlay portion 2158. In another example, the second overlay portion 2152 extends on the second medial midfoot edge 2130. Similar to the above, this arrangement helps to finish the second medial midfoot edge 2130 of the second braided structure 2008 by bonding any open strands to the second overlay portion 2152.

In some embodiments, the overlay system extends along a forward fastening edge to support the first braided structure and/or the second braided structure. For example, as shown in FIG. 21, the sixth overlay portion 2156 may extend on the first forward fastening edge 2229. This arrangement helps to finish the first forward fastening edge 2229 by bonding any open strands to the sixth overlay portion 2156. In another example, the third overlay portion 2150 extends on the second forward fastening edge 2129. Similar to the above, this arrangement helps to finish the second forward fastening edge 2129 of the second braided structure 2008 by bonding any open strands to the third overlay portion 2150.

In one embodiment, the overlay system extends along a lateral fastening edge to support the first braided structure and/or the second braided structure. For example, as shown in FIG. 21, the sixth overlay portion 2156 may extend on the first lateral fastening edge 2226. This arrangement helps to finish the first lateral fastening edge 2226 by bonding any open strands to the sixth overlay portion 2156. In another example, the third overlay portion 2150 extends on the second lateral fastening edge 2126. Similar to the above, this arrangement helps to finish the second lateral fastening edge 2126 of the second braided structure 2008 by bonding any open strands to the third overlay portion 2150.

In various embodiments, the overlay system extends along a medial fastening edge to support the first braided structure and/or the second braided structure. For example, as shown in FIG. 21, the sixth overlay portion 2156 may extend on the first medial fastening edge 2227. This arrangement helps to finish the first medial fastening edge 2227 by bonding any open strands to the sixth overlay portion 2156. In another example, the third overlay portion 2150 extends on the second medial fastening edge 2127. Similar to the above, this arrangement helps to finish the second medial fastening edge 2127 of the second braided structure 2008 by bonding any open strands to the third overlay portion 2150.

FIG. 21 depicts the first braided structure 2006 having an opening defined by a plurality of edges that includes the first opening edge 2296, the first medial midfoot edge 2230, the first lateral midfoot edge 2232, the first lateral fastening edge 2226, the first medial fastening edge 2227, and the first forward fastening edge 2229. FIG. 21 also depicts the second braided structure 2008 having an opening defined by a plurality of edges that includes the second opening edge 2196, the second medial midfoot edge 2130, the second lateral midfoot edge 2132, the second lateral fastening edge 2126, the second medial fastening edge 2127, and the second forward fastening edge 2129. At least some of these edges in the first braided structure 2006 (e.g., the first medial midfoot edge 2230, the first lateral midfoot edge 2232, the first lateral fastening edge 2226, and the first medial fastening edge 2227) form a first angled notch portion on the medial side and a second angled notch portion on the lateral side. Similarly, at least some of these edges in the second braided structure 2008 (e.g., the second medial midfoot edge 2130, the second lateral midfoot edge 2132, the second lateral fastening edge 2126, and the second medial fastening edge 2127) form a first angled notch portion on the medial side and a second angled notch portion on the lateral side. The notches extend downward on their respective sides within an instep region of the upper. As shown in FIG. 21 as well as FIG. 20, the first layer 2144 of the overlay system 2140 is configured to extend from the first angled notch portion on the medial side 18 of the first braided structure 2006 to a lower side (e.g., extends under the foot of the wearer) of the first braided structure 2006 and continuously from the lower side to the second angled notch portion on the lateral side 16 of the first braided structure 2006. Similarly, the second layer 2142 of the overlay system 2140 is configured to extend from the first angled notch portion on the medial side 18 of the second braided structure 2008 to a lower side of the second braided structure 2008 and continuously from the lower side to the second angled notch portion on the lateral side 16 of the second braided structure 2008.

Figure 22:
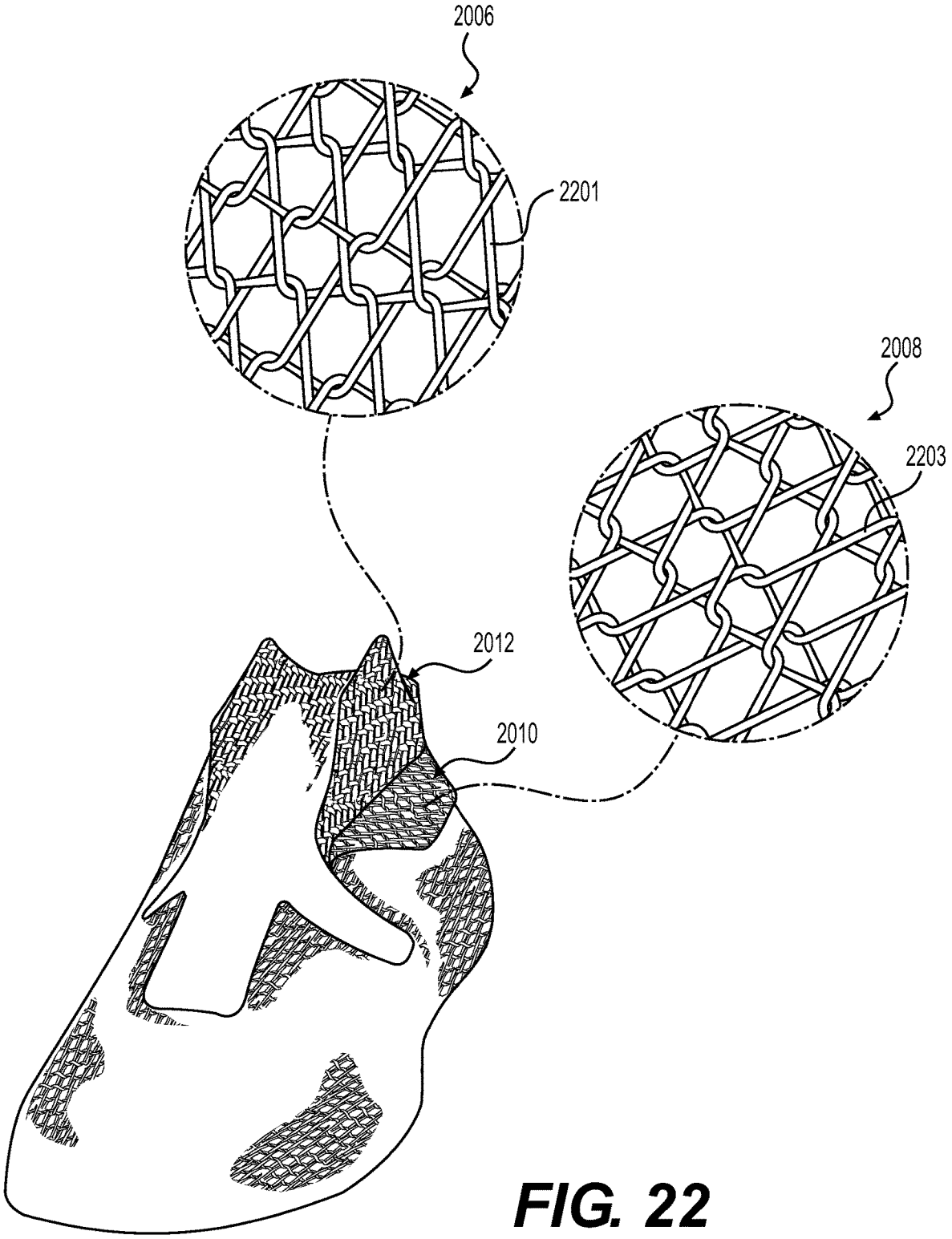
FIG. 22 is a schematic view of the article of footwear of FIG. 20, including an enlarged view of strands disposed against the overlay.

In some instances, the second braided structure overlaps an outer surface of the first braided structure. For example, as shown in FIG. 22, an inner surface 2010 of the second braided structure 2008 substantially overlaps an outer surface 2012 of the first braided structure 2006. As used herein, a surface substantially overlaps another surface when the first surface covers at least 60 percent of the other surface. In some cases, inner surface 2010 and outer surface 2012 could overlap by anywhere between 60 to 100 percent (e.g., 70 percent, 80 percent, 90 percent, 95 percent, or 99 percent). Moreover, in one embodiment, the inner surface of the second braided structure is in direct contact with the outer surface of the first braided structure. For example, as shown in FIG. 22, the inner surface 2010 is placed directly into contact with the outer surface 2012. In some instances, the overlay system holds the outer surface of the second braided structure is in direct contact with the outer surface of the first braided structure. For example, the overlay system 2140 may bond the inner surface 2010 directly onto the outer surface 2012 (see FIG. 24).

Figure 23:
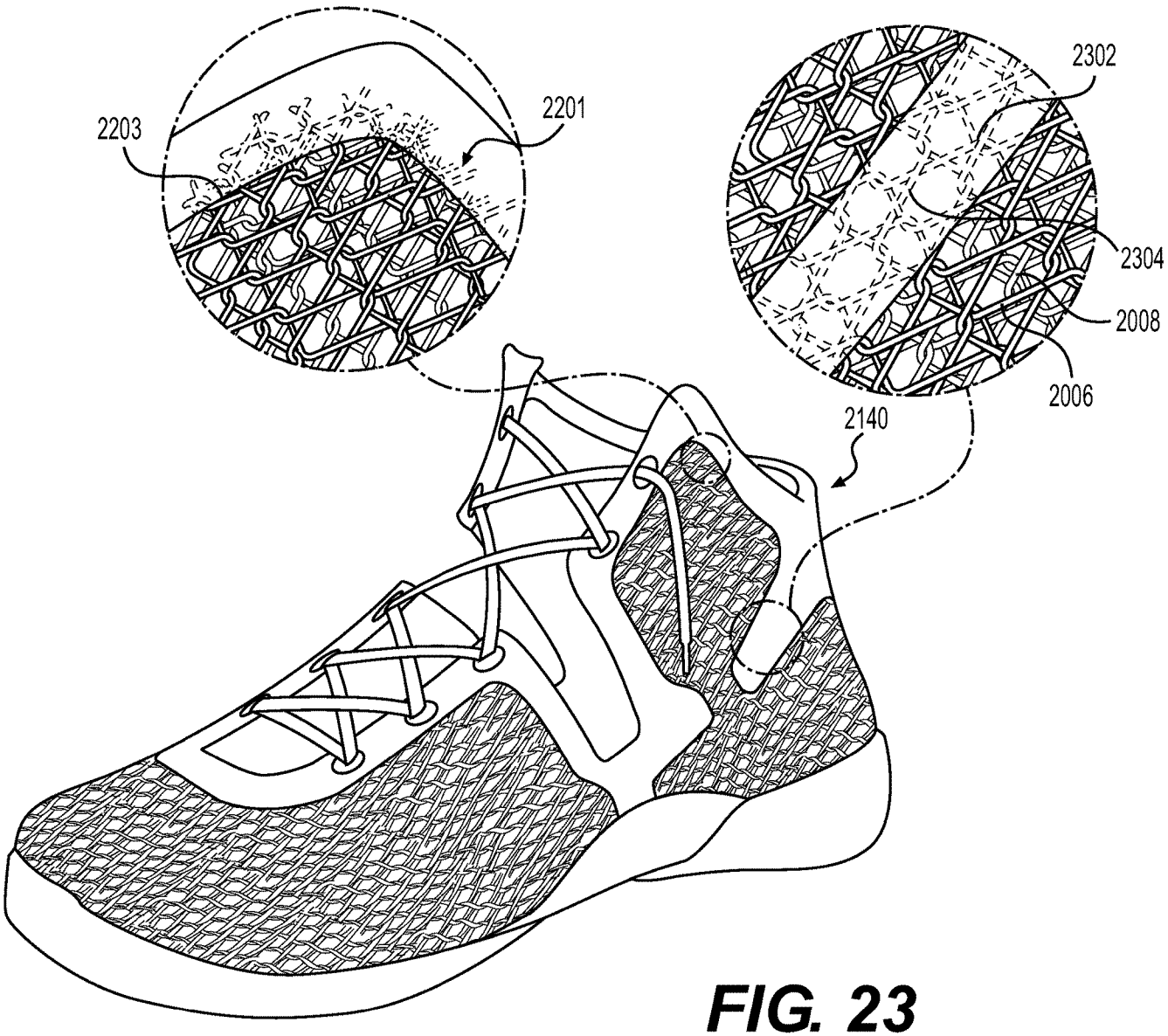
FIG. 23 is a schematic view of an arrangement of strands bonded to an overlay, in accordance with an exemplary embodiment.

As shown in FIG. 22, the first braided structure 2006 may include a strand 2201. Strand 2201 may be representative of a plurality of strands of the first braided structure 2006 and/or of a plurality of strands of the second braided structure 2008. In some instances, the first braided structure 2006 may be damaged by pulling of the strand 2201. Accordingly, as shown in FIG. 23, the overlay system 2140 may be used to prevent a pulling of the strand 2201. In some embodiments, the second overlay portion 2152 may be used to prevent strand 2201 from being pulled.

Additionally, as shown in FIG. 22, the second braided structure 2008 may include a strand 2203. Strand 2203 may be representative of a plurality of strands of the first braided structure 2006 and/or of a plurality of strands of the second braided structure 2008. In some instances, the second braided structure 2008 may be damaged by pulling of the strand 2203. Accordingly, as shown in FIG. 23, the overlay system 2140 may be used to prevent a pulling of the strand 2203. In some embodiments, the fifth overlay portion 2158 may be used to prevent strand 2201 from being pulled.

In various embodiments, the overlay system 2140 may hold the first braided structure 2006 and/or the second braided structure 2008 in a particular position. For example, as illustrated in FIG. 23, the overlay system 2140 holds into place strand 2201 of the first braided structure 2006 and strand 2203 of the second braided structure 2008. In one embodiment, the second overlay portion 2152 holds into place strand 2203 of the second braided structure 2008. In some embodiments, the fifth overlay portion 2158 holds into place strand 2201 of the first braided structure 2006.

In one embodiment, the overlay system holds the first braided structure in a relative position with the second braided structure. For example, as shown in FIG. 23, the overlay system 2140 holds the first braided structure 2006 in direct contract with the second braided structure 2008. In various embodiments, the second overlay portion 2152 holds into place the second braided structure 2008, the fifth overlay portion 2158 holds into place the first braided structure 2006, and the second overlay portion 2152 and the fifth overlay portion 2158 are bonded together to hold the first braided structure 2006 in a relative position with the second braided structure 2008.

In some embodiments, the overlay portion holds a strand of the first braided structure in a position with a strand of the second braided structure. For example, as shown in FIG. 23, the overlay system 2140 holds the first strand 2302 of the first braided structure 2006 in direct contract with the second strand 2304 of the second braided structure 2008. In various embodiments, the second overlay portion 2152 holds into place second strand 2304, the fifth overlay portion 2158 holds into place first strand 2302, and the second overlay portion 2152 and the fifth overlay portion 2158 are bonded together to hold the first strand 2302 in a relative position with the second strand 2304.

Figure 24:
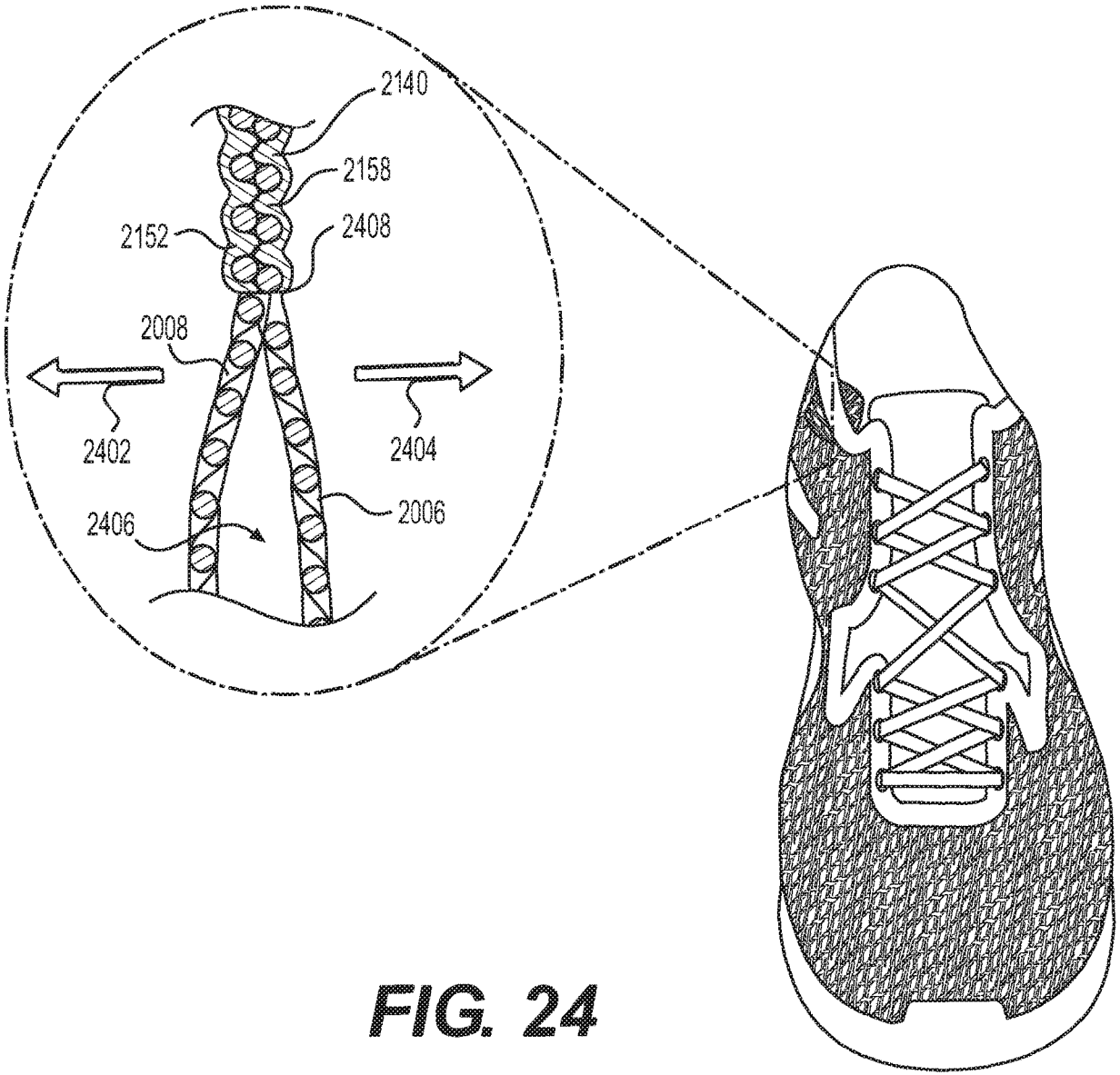
FIG. 24 is a schematic view of the article of footwear of FIG. 20, including an enlarged view of an exemplary separating of the first braided structure and the second braided structure.

In some instances, the overlay system 2140 may be configured to prevent a separation of the first braided structure 2006 and the second braided structure 2008. For instance, as shown in FIG. 24, a medial force 2402 is applied to the second braided structure 2008. Moreover, in the example, a lateral force 2404 may applied to the first braided structure 2006. As such, the first braided structure 2006 and the second braided structure 2008 are separated in central portion 2406. Moreover, as shown in FIG. 24, the overlay system 2140 prevents the first braided structure 2006 and the second braided structure 2008 from separating at an overlay portion 2408. As noted above, in some embodiments, the second overlay portion 2152 and the fifth overlay portion 2158 are bonded together to prevent a separation of the first braided structure 2006 and the second braided structure 2008.

Figure 25:
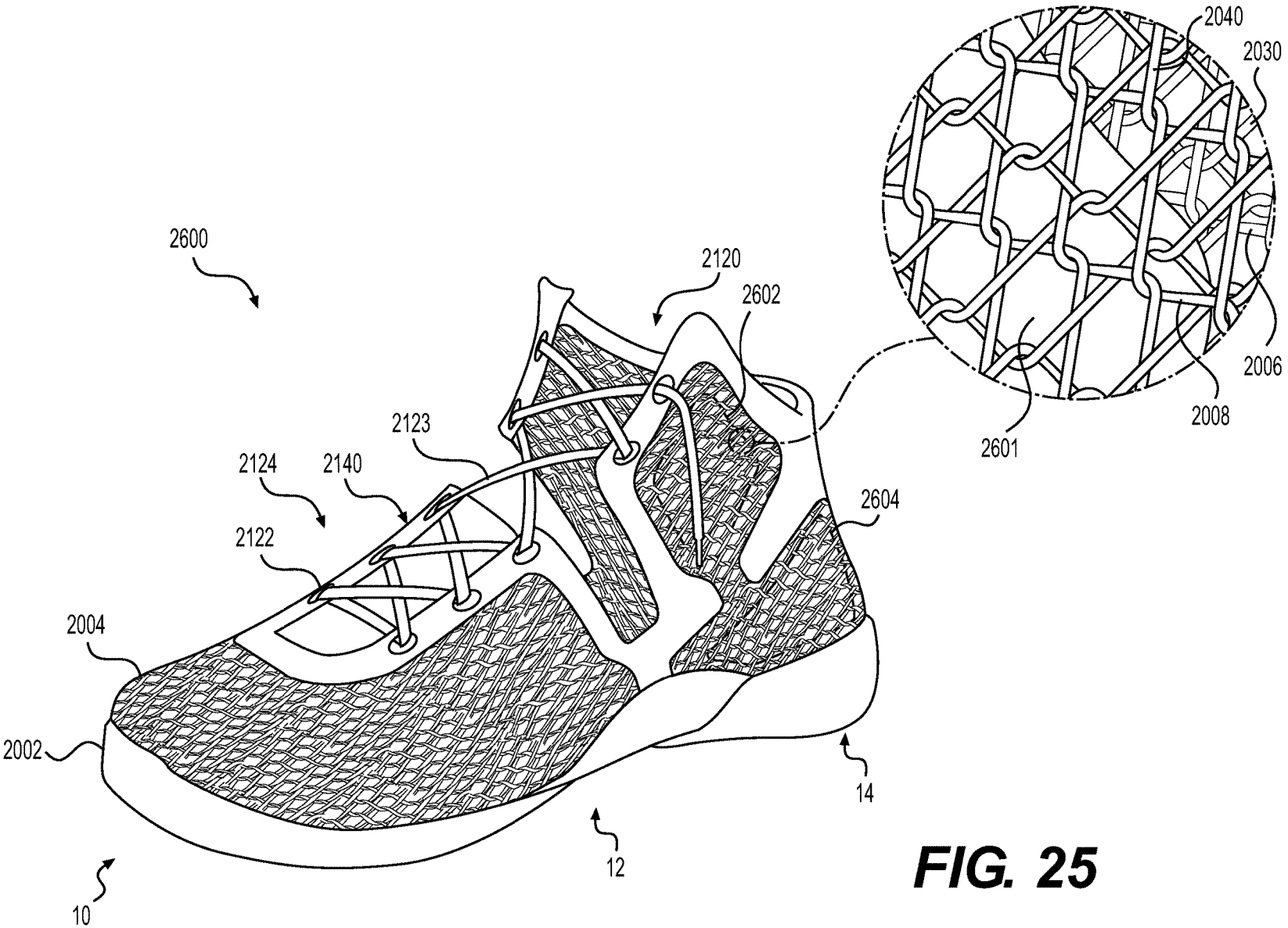
FIG. 25 is an isometric view of an exemplary embodiment of an article of footwear with a first braided structure, a second braided structure, an intermediate layer, and an overlay.
Figure 26:
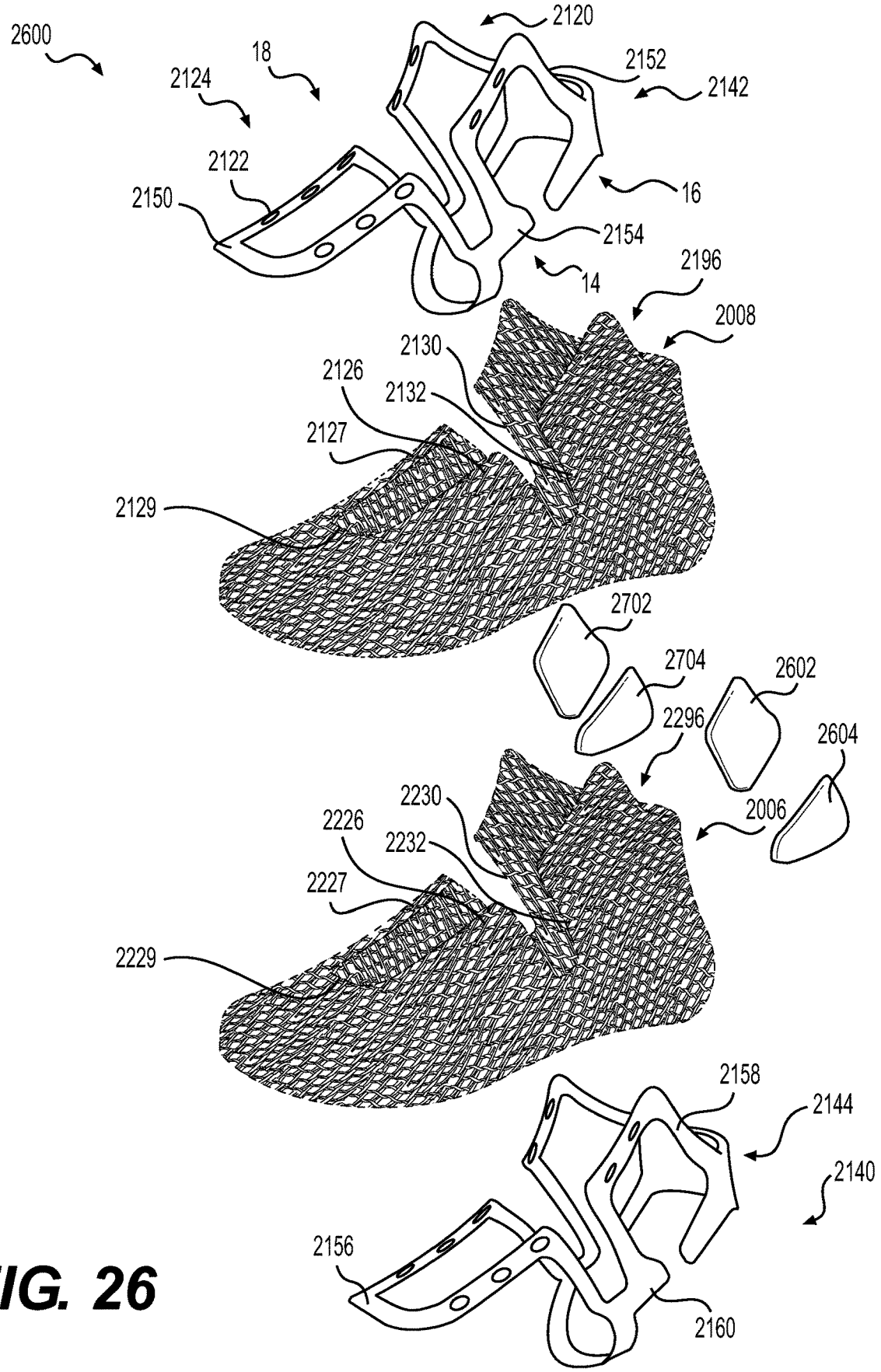
FIG. 26 is an exploded view of the article of footwear of FIG. 25, in accordance with an exemplary embodiment.

In some embodiments, it is desirable to provide an intermediate layer to provide a cushioning function. For example, FIGS. 25-34 illustrate embodiments that include an intermediate layer. As shown in FIG. 25, an article of footwear 2600, or simply article 2600, is substantially similar to the article 2000 except that the article 2600 further includes an intermediate layer 2601.

In one embodiment, the intermediate layer may include any number of members placed in various locations of the article 2600. For example, as shown in FIG. 25, the intermediate layer 2601 may include, as a first member, an ankle pad 2602 and, as a second member, a heel pad 2604. In other embodiments, the intermediate layer 2601 may include one member, or more than two members (see FIG. 26). Moreover, in some embodiments, the intermediate layer 2601 includes members in other portions of the shoe, for example, the midfoot portion 12 and the forefoot portion 10 (not shown).

In some embodiments, the lateral side 16 may include a third member corresponding to the first member of the medial side 18. For example, the intermediate layer 2601 may include ankle pad 2702 (see FIGS. 26-27). In some instances, the ankle pad 2602 has one or more features that are substantially similar to ankle pad 2702. In other instances, the ankle pad 2602 and the ankle pad 2702 are different.

In one embodiment, the lateral side 16 may include a fourth member corresponding to the second member of the medial side 18. For example, the intermediate layer 2601 may include heel pad 2604 (see FIGS. 26-27). In some instances, the heel pad 2604 has one or more features that are substantially similar to heel pad 2704. In other instances, the heel pad 2604 and the heel pad 2704 are different.

Figure 27:
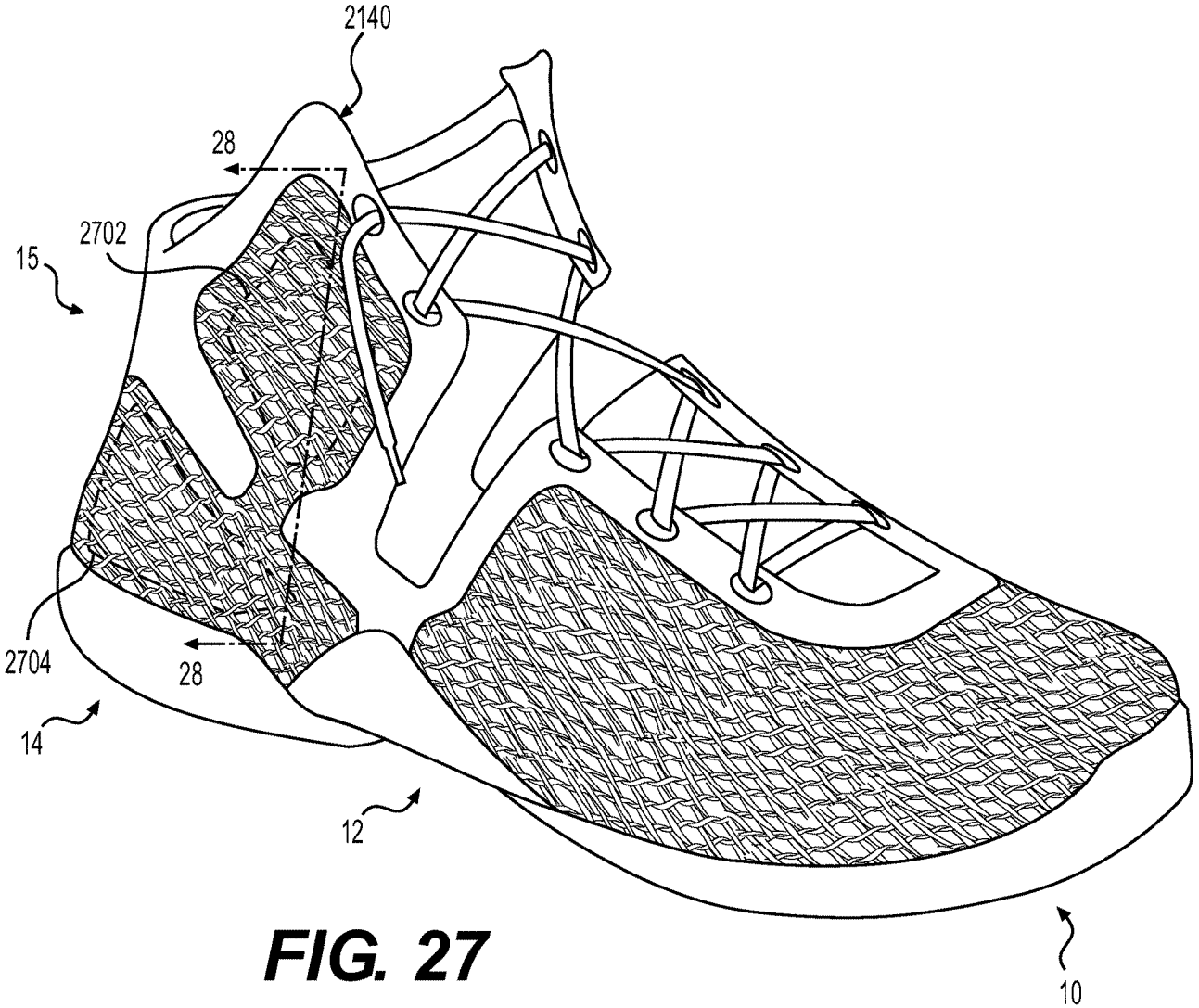
FIG. 27 is a schematic view of a medial side of the article of footwear of FIG. 25, in accordance with an exemplary embodiment.

In some instances, it may be desirable to provide cushioning to a user's foot. In such instances, the intermediate layer may be placed to provide a cushioning to a user's foot. For example, as shown in FIG. 27, the ankle pad 2702 is positioned in an ankle portion 15. Moreover, as shown, the heel pad 2704 is positioned in the heel portion 14.

In one embodiment, the intermediate layer is formed of foam. For example, the ankle pad 2602, the heel pad 2604, the ankle pad 2702, and/or the heel pad 2704 may be formed of ethylene vinyl acetate (e.g., EVA). In other instances, the intermediate lay is formed of a polymer. For example, the ankle pad 2602, the heel pad 2604, the ankle pad 2702, and the heel pad 2704 may be formed of a thermoplastic.

In some embodiments, the overlay system substantially surrounds one or more members of the intermediate layer 2601. For example, as shown in FIG. 27, the overlay system 2140 substantially surrounds the ankle pad 2702. As used herein, substantially surrounds includes surrounding more than sixty percent.

Figure 28:
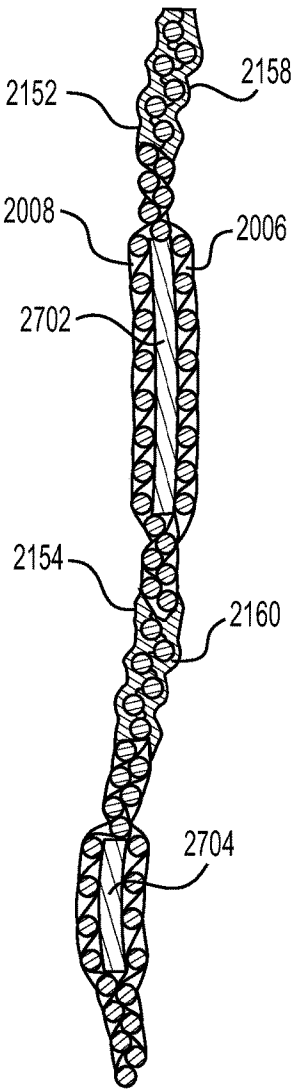
FIG. 28 is cross sectional view of the article of footwear of FIG. 27, in accordance with an exemplary embodiment.

In various embodiments, the first braided structure 2006 and the second braided structure are separated by the intermediate layer. For example, as shown in FIG. 28, the ankle pad 2702 is positioned between the first braided structure 2006 and the second braided structure 2008. In another example, the heel pad 2704 is positioned between the first braided structure 2006 and the second braided structure 2008.

In some embodiments, one or more members of the intermediate layer 2601 may directly contact with the first braided structure. For example, as shown in FIG. 28, the ankle pad 2702 directly contacts the first braided structure 2006. In another example, the heel pad 2704 directly contacts the first braided structure 2006. Similarly, in some embodiments, one or more members of the intermediate layer 2601 may directly contact with the second braided structure. For example, as shown in FIG. 28, the ankle pad 2702 directly contacts the second braided structure 2008. In another example, the heel pad 2704 directly contacts the second braided structure 2008.

In one embodiment, one or more members of the intermediate layer are held into position by the overlay system. For example, as shown in FIG. 28, the ankle pad 2702 is held between the first overlay portion 2154 and the second overlay portion 2152. In another example, the ankle pad 2702 is held between the fourth overlay portion 2160 and the fifth overlay portion 2158. In some embodiments, the heel pad is held into position by the overlay system and the sole system. For example, as shown, the heel pad 2704 may be held into position by the first overlay portion 2154. In another example, the heel pad 2704 may be held into position by the fourth overlay portion 2160.

In some embodiments, one or more members of the intermediate layer are flexibly held into position by the overlay system 2140. In one embodiment, the intermediate layer is flexibly held by spacing one or more members of the intermediate layer from the overlay system 2140. For example, as shown in FIGS. 27-28, the ankle pad 2702 is spaced from the second overlay portion 2152. In another example, the ankle pad 2702 is spaced from the first overlay portion 2154. In yet another example, the ankle pad 2702 is spaced from the fifth overlay portion 2158. In one example, the ankle pad 2702 is spaced from the fourth overlay portion 2160. Similarly, the heel pad 2704 may be spaced from one or more of the first overlay portion 2154, second overlay portion 2152, the third overlay portion 2150, the fourth overlay portion 2160, the fifth overlay portion 2158, and the sixth overlay portion 2156.

Figure 29:
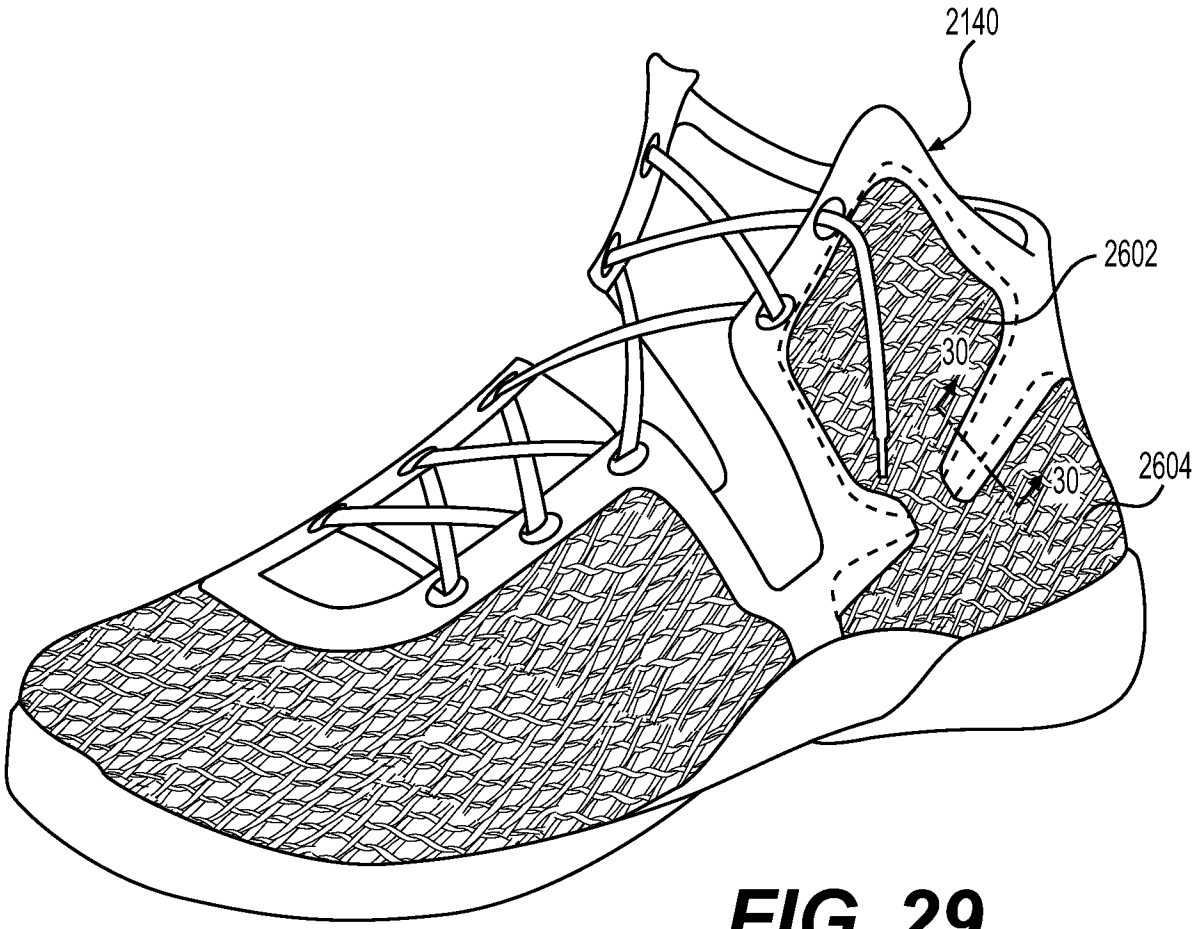
FIG. 29 is an isometric view of an exemplary embodiment of an article of footwear with a first braided structure, a second braided structure, an intermediate layer, and an overlay.

In other embodiments, one or more members of the intermediate layer may be rigidly held into a position by the overlay system. For example, as shown in FIG. 29, the ankle pad 2602 is rigidly attached to the overlay system 2140. In another example, the heel pad 2604 is rigidly attached to the overlay system 2140.

Figure 30:
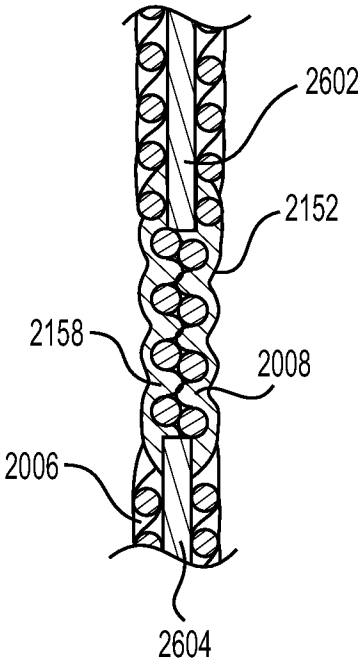
FIG. 30 is cross sectional view of the article of footwear of FIG. 29, in accordance with an exemplary embodiment.

In various embodiments, one or more members of the intermediate layer 2601 may directly contact the overlay system 2140. For example, as shown in FIG. 30, the ankle pad 2602 directly contacts the second overlay portion 2152 and/or the fifth overlay portion 2158. In another example, the heel pad 2604 directly contacts the second overlay portion 2152 and/or the fifth overlay portion 2158.

The embodiments described herein and shown in FIGS. 20-30, for example, provide means of selectively modifying the material characteristics of an upper. Specifically, overlay portions may be applied at selective locations of an upper (and not applied in other locations) to enhance stretch resistance, strength, rigidity and/or other material properties at the selective locations. For example, in the embodiments shown in FIGS. 20-24, overlay system 2140 includes overlay portions that are selectively placed on the edges of first braided structure 2006 and second braided structure 2008, but not in some portions interior to these edges (e.g., a toe portion, some of the lateral and medial sides and some of the bottom side of upper 2004). This selective placement of overlay portions allows for improved stretch resistance and strength at the edges, but retains improved flexibility, relatively low rigidity, and breathability in portions not covered by overlay portions.

Figure 31:
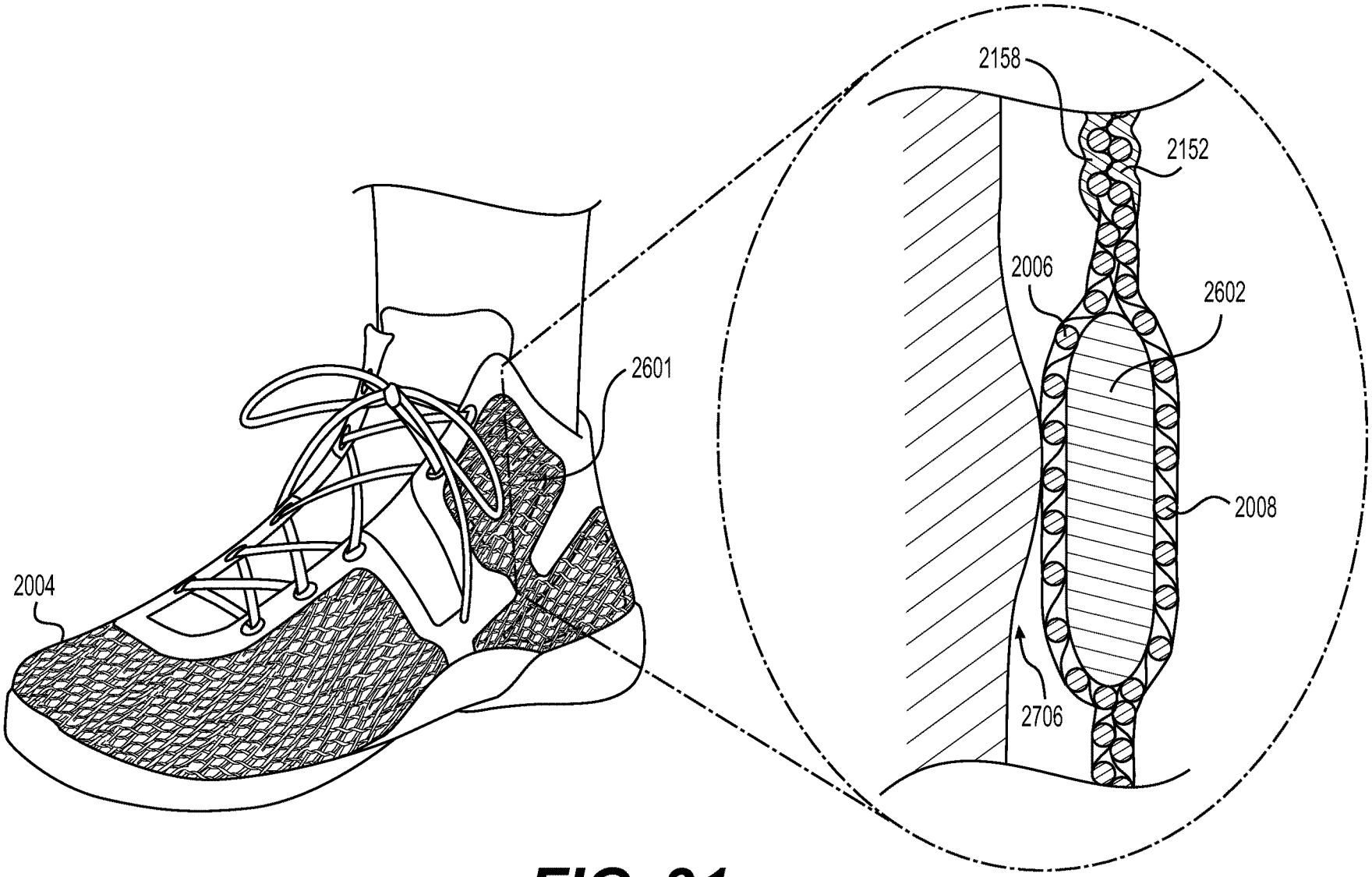
FIG. 31 is an isometric view of an exemplary embodiment of an article of footwear with a first braided structure, a second braided structure, and an intermediate layer prior to an impact.
Figure 32:
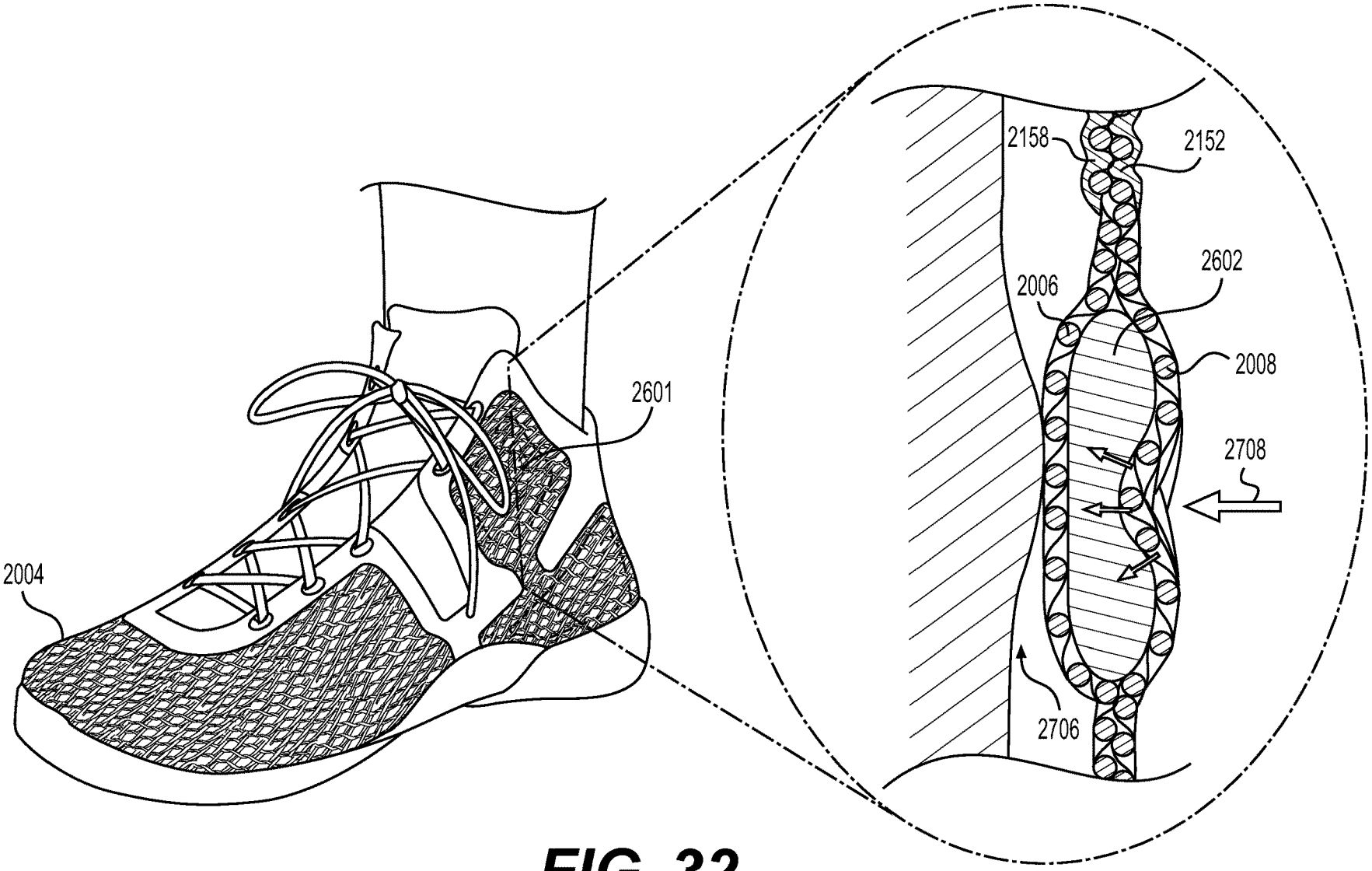
FIG. 32 is an isometric view of an exemplary embodiment of an article of footwear with a first braided structure, a second braided structure, and an intermediate layer during an impact.

FIGS. 31 and 32 illustrate an improved functionality of upper 2004 due to the use of selective placement of overlay portions in some areas, but not others, of upper 2004. As seen in the enlarged cross-sectional view of FIG. 31, ankle pad 2602 is held between first braided structure 2006 and second braided structure 2008. Moreover, to keep ankle pad 2602 from moving outside the ankle region of upper 2004, second overlay portion 2152 and fifth overlay portion 2158 are bonded to first braided structure 2006 and second braided structure 2008 (and to one another) to help hold ankle pad 2602 in a predetermined region of upper 2004. Specifically, second overlay portion 2152 and fifth overlay portion 2158 keep first braided structure 2006 and second braided structure 2008 attached around ankle pad 2602 such that ankle pad 2602 cannot translate outside of the boundary defined by second overlay portion 2152 and fifth overlay portion 2158.

In some embodiments, the upper 2004 may allow for an improved impact absorption by distributing an impact force onto an intermediate layer 2601. For example, FIG. 31 illustrates the ankle pad 2602 positioned to protect the ankle 2706. Moreover, as shown, the first braided structure 2006 and the second braided structure 2008 support the ankle pad 2602. As illustrated in FIG. 32, in the example, a force 2708 contacting the second braided structure 2008 deforms the second braided structure 2008 to distribute force 2708. Such a deformation may help the intermediate layer 2601 (e.g., ankle pad 2602) absorb the impact by distributing the impact force 2708 into the intermediate layer 2601.

Second braided structure 2008 may be easily deformed due to its low rigidity and relative flexibility. This may be in contrast to regions of upper 2004 that include overlay portions, which may be specifically designed to limit flexibility and may generally increase rigidity of these regions to strengthen the connection between first braided structure 2006 and second braided structure 2008. Thus, it may be appreciated that the selective modification of the characteristics of different regions of an upper using overlay portions may help to maintain desired flexibility and low rigidity in some regions of the upper while increasing strength and reducing stretch resistance in other regions of the upper.

Figure 34:
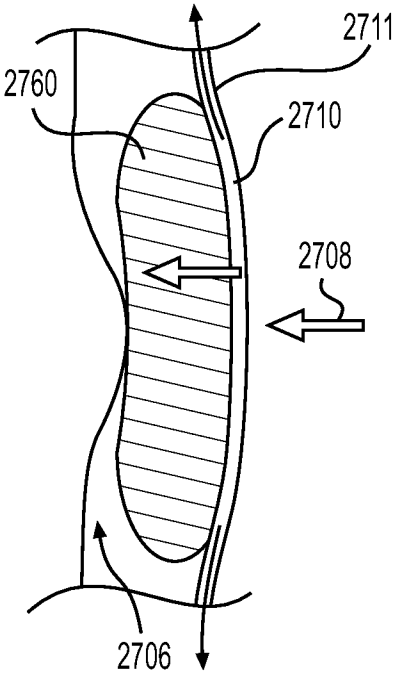
FIG. 34 is an isometric view of an exemplary embodiment of an article of footwear with a rigid upper and an intermediate layer during an impact.
Figure 33:
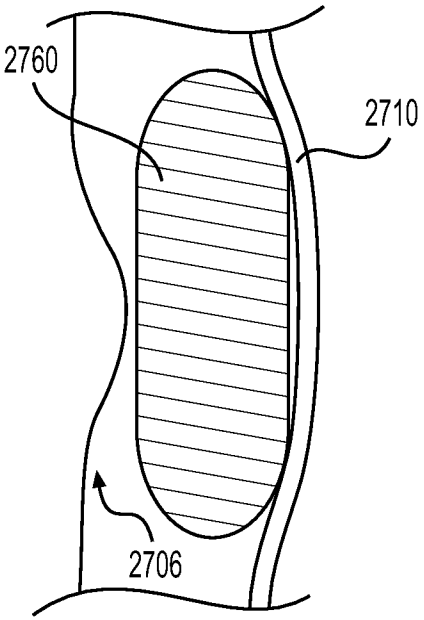
FIG. 33 is an isometric view of an exemplary embodiment of an article of footwear with a rigid upper and an intermediate layer prior to an impact.

An alternative embodiment of a portion of an upper including an intermediate cushioning layer 2760 and a rigid layer 2710 is shown in FIGS. 33 and 34. In this alternative embodiment, rigid layer 2710 may generally have a uniform rigidity, stretch resistance and/or strength, as opposed to the selective material characteristics provided by the embodiment shown in FIGS. 31-32. As shown in FIG. 34, a force 2708 applied to the rigid upper 2710 may be partially transmitted to intermediate cushioning layer 2760. However, because of the relative inflexibility of rigid upper 2710, some of force 2708 may also be transmitted along regions 2711 of rigid upper 2710 that are peripheral of intermediate cushioning layer 2760. This may result in less efficient cushioning, as only some of force 2708 is absorbed by intermediate cushioning layer 2760, while the rest of force 2708 is transmitted to other locations of rigid upper 2710.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper and a sole system;

wherein the upper comprises a first braided structure, a second braided structure, and an overlay system comprising a first overlay layer and a second overlay layer;

wherein the first braided structure includes a first plurality of edges that form a first angled notch portion extending downward on a medial side of an instep region of the upper and a second angled notch portion extending downward on a lateral side of the instep region of the upper, and the second braided structure includes a second plurality of edges that form a first angled notch portion on the medial side and a second angled notch portion on the lateral side, the first plurality of edges and the second plurality of edges collectively defining a foot-receiving opening;

wherein the first braided structure and the second braided structure each include a lower side that is configured to extend under a foot of a wearer;

wherein the first overlay layer is bonded to a first portion of the first braided structure and wherein the second overlay layer is bonded to a first portion of the second braided structure, the first overlay layer extending continuously from a bottom of the first angled notch portion of the first braided structure downward to the lower side of first braided structure and further continuously from the lower side of the first braided structure upward to a bottom of the second angled notch portion of the first braided structure, the second overlay layer extending continuously from a bottom of the first angled notch portion of the second braided structure downward to the lower side of second braided structure and further continuously from the lower side of the second braided structure upward to a bottom of the second angled notch portion of the second braided structure;

wherein the first portion of the first braided structure is positioned between the first overlay layer and the first portion of the second braided structure, and wherein the first portion of the second braided structure is positioned between the first portion of the first braided structure and the second overlay layer; and wherein the first overlay layer is more resistant to stretching than a second portion of the first braided structure that is not directly bonded to the first overlay layer and wherein the second overlay layer is more resistant to stretching than a second portion of the second braided structure that is not directly bonded to the second overlay layer.

2. The article of footwear according to claim 1, wherein a substantial portion of the second braided structure is overlapping and directly contacting the first braided structure.

3. The article of footwear according to claim 1, wherein the first overlay layer is bonded to the second overlay layer.

4. The article of footwear according to claim 1, wherein an intermediate layer separates the first braided structure and the second braided structure.

5. The article of footwear according to claim 4, wherein the intermediate layer is foam; and wherein an edge of the intermediate layer is bonded to the overlay system.

6. An article of footwear, comprising:

an upper and a sole system;

the upper comprising:

a first braided structure having a first plurality of edges that form a first angled notch portion extending downward on a medial side of an instep region of the upper and a second angled notch portion extending downward on a lateral side of the instep region of the upper, and having a lower side that is configured to extend under a foot of a wearer;

a second braided structure having a second plurality of edges that form a first angled notch portion on the medial side of the instep region of the upper and a second angled notch portion on the lateral side of the instep region of the upper, and having a lower side that is configured to extend under the foot of the wearer, wherein the first plurality of edges of the first braided structure and the second plurality of edges of the second braided structure collectively define a foot-receiving opening;

a member; and an overlay system comprising a first overlay layer and a second overlay layer;

wherein the first overlay layer is bonded to a first portion of the first braided structure and wherein the second overlay layer is bonded to a first portion of the second braided structure, the first overlay layer extending continuously from a bottom of the first angled notch portion of the first braided structure downward to the lower side of first braided structure and further continuously from the lower side of the first braided structure upward to a bottom of the second angled notch portion of the first braided structure, the second overlay layer extending continuously from a bottom of the first angled notch portion of the second braided structure downward to the lower side of second braided structure and further continuously from the lower side of the second braided structure upward to a bottom of the second angled notch portion of the second braided structure;

wherein the first portion of the first braided structure is positioned between a first portion of the first overlay layer and the first portion of the second braided structure, and wherein the first portion of the second braided structure is positioned between the first portion of the first braided structure and a first portion of the second overlay layer;

wherein the first overlay layer is more resistant to stretching than a second portion of the first braided structure that is not directly bonded to the first overlay layer and wherein the second overlay layer is more resistant to stretching than a second portion of the second braided structure that is not directly bonded to the second overlay layer;

wherein the member is positioned between the first braided structure and the second braided structure.

7. The article of footwear according to claim 6, wherein the member directly contacts the first braided structure; and wherein the member directly contacts the second braided structure.

8. The article of footwear according to claim 7, wherein the overlay system substantially surrounds at least a portion of the member.

9. The article of footwear according to claim 6, wherein the member is an ankle pad, the ankle pad being positioned in an ankle portion of the article of footwear; and wherein the upper further includes a heel pad, the heel pad being positioned in a heel portion of the article of footwear.

10. The article of footwear according to claim 6, wherein the member is made of foam and wherein the overlay system is made of thermoplastic.

11. An upper for an article of footwear, the upper comprising:

a first braided structure including a first plurality of edges that form a first angled notch portion extending downward on a medial side of an instep region of the upper and a second angled notch portion extending downward on a lateral side of the instep region of the upper, the first braided structure further including a lower side that is configured to extend under a foot of a wearer;

a second braided structure including a second plurality of edges that form a first angled notch portion on the medial side of the instep region of the upper and a second angled notch portion on the lateral side of the instep region of the upper, the first plurality of edges and the second plurality of edges collectively defining a foot-receiving opening, the second braided structure further including a lower side that is configured to extend under the foot of the wearer;

an overlay system including a first layer and a second layer;

wherein the first layer is bonded to the first plurality of edges of the first braided structure at least at the first angled notch portion of the first braided structure and the second angled notch portion of the first braided structure, the first layer extending continuously from a bottom of the first angled notch portion of the first braided structure downward to the lower side of the first braided structure and further continuously from the lower side of the first braided structure upward to a bottom of the second angled notch portion of the first braided structure;

wherein the second layer is bonded to the second plurality of edges of the second braided structure at least at the first angled notch portion of the second braided structure and the second angled notch portion of the second braided structure, the second layer extending continuously from a bottom of the first angled notch portion of the second braided structure downward to the lower side of the second braided structure and further continuously from the lower side of the second braided structure upward to a bottom of the second angled notch portion of the second braided structure;

wherein the first plurality of edges of the first braided structure is positioned between at least a portion of the first layer of the overlay system and the second plurality of edges of the second braided structure, and wherein the second plurality of edges of the second braided structure is positioned between the first plurality of edges of the first braided structure and at least a portion of the second layer of the overlay system;

wherein the first layer of the overlay system is more resistant to stretching than a portion of the first braided structure that is not directly bonded to the first layer, and wherein the second layer of the overlay system is more resistant to stretching than a portion of the second braided structure that is not directly bonded to the second layer; and wherein the first layer is bonded to the second layer.

12. The upper according to claim 11, further comprising:

an intermediate layer, the intermediate layer being positioned between the first braided structure and the second braided structure.

13. The upper according to claim 12, wherein the second layer of the overlay system includes a first portion and a second portion;

wherein the second portion extends along an edge within the second plurality of edges; and wherein the intermediate layer comprises a plurality of members, wherein a first member of the plurality of members is positioned between the first portion and the second portion.

14. The upper according to claim 13, wherein the first member is spaced from the second portion; and wherein the first member is spaced from the first portion.

15. The upper according to claim 13, wherein the first member is attached to the second portion; and wherein the first member is attached to the first portion.

16. The upper according to claim 13, wherein the first layer includes a third portion and a fourth portion;

wherein the fourth portion extends along an edge within the first plurality of edges; and wherein the first member of the plurality of members is positioned between the third portion and the fourth portion.

* * * * *